US008428957B2

(12) United States Patent
Garudadri et al.

(10) Patent No.: US 8,428,957 B2
(45) Date of Patent: Apr. 23, 2013

(54) SPECTRAL NOISE SHAPING IN AUDIO CODING BASED ON SPECTRAL DYNAMICS IN FREQUENCY SUB-BANDS

(75) Inventors: Harinath Garudadri, San Diego, CA (US); Sriram Ganapathy, Baltimore, MD (US); Petr Motlicek, Martigny-Croix (CH); Hynek Hermansky, Baltimore, MD (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 12/197,069

(22) Filed: Aug. 22, 2008

(65) Prior Publication Data

US 2011/0270616 A1 Nov. 3, 2011

Related U.S. Application Data

(60) Provisional application No. 60/957,987, filed on Aug. 24, 2007.

(51) Int. Cl.
*G10L 19/00* (2006.01)

(52) U.S. Cl.
USPC ..... 704/500; 704/501; 704/503; 704/504; 704/200

(58) Field of Classification Search ..... 704/500, 704/501, 503, 504, 200
See application file for complete search history.

(56) References Cited

U.S. PATENT DOCUMENTS 4,184,049 A 1/1980 Crochiere et al.
4,192,968 A 3/1980 Hilbert et al.
4,584,534 A 4/1986 Lijphart et al.
4,902,979 A 2/1990 Puckette, IV
5,640,698 A 6/1997 Shen et al.

(Continued)

FOREIGN PATENT DOCUMENTS

EP 0782128 A1 7/1997
EP 0867862 A2 9/1998

(Continued)

OTHER PUBLICATIONS

Herre, Jürgen, "Temporal Noise Shaping, Quantization and Coding Methods in Perceptual Audio Coding: A Tutorial Introduction", Proceedings of the AES 17th International Conference: High-Quality Audio Coding, Florence, Italy, Sep. 2-5, 1999.

(Continued)

*Primary Examiner* — Qi Han
(74) *Attorney, Agent, or Firm* — Espartaco Diaz Hidalgo

(57) ABSTRACT

A technique of spectral noise shaping in an audio coding system is disclosed. Frequency decomposition of an input audio signal is performed to obtain multiple frequency sub-bands that closely follow critical bands of human auditory system decomposition. The tonality of each sub-band is determined. If a sub-band is tonal, time domain linear prediction (TDLP) processing is applied to the sub-band, yielding a residual signal and linear predictive coding (LPC) coefficients of an all-pole model representing the sub-band signal. The residual signal is further processed using a frequency domain linear prediction (FDLP) method. The FDLP parameters and LPC coefficients are transferred to a decoder. At the decoder, an inverse-FDLP process is applied to the encoded residual signal followed by an inverse TDLP process, which shapes the quantization noise according to the power spectral density of the original sub-band signal. Non-tonal sub-band signals bypass the TDLP process.

46 Claims, 17 Drawing Sheets

U.S. PATENT DOCUMENTS

| | | | | |
|---|---|---|---|---|
| 5,651,090 | A | 7/1997 | Moriya et al. | |
| 5,715,281 | A | 2/1998 | Bly et al. | |
| 5,778,338 | A | 7/1998 | Jacobs et al. | |
| 5,781,888 | A * | 7/1998 | Herre | 704/200.1 |
| 5,802,463 | A | 9/1998 | Zuckerman | |
| 5,825,242 | A | 10/1998 | Prodan et al. | |
| 5,838,268 | A | 11/1998 | Frenkel | |
| 5,884,010 | A | 3/1999 | Chen et al. | |
| 5,943,132 | A | 8/1999 | Erskine | |
| 6,014,621 | A * | 1/2000 | Chen | 704/220 |
| 6,091,773 | A | 7/2000 | Sydorenko | |
| 6,243,670 | B1 | 6/2001 | Bessho et al. | |
| 6,680,972 | B1 | 1/2004 | Liljeryd et al. | |
| 6,686,879 | B2 | 2/2004 | Shattil | |
| 7,155,383 | B2 | 12/2006 | Chen et al. | |
| 7,173,966 | B2 | 2/2007 | Miller | |
| 7,206,359 | B2 | 4/2007 | Kjeldsen et al. | |
| 7,430,257 | B1 | 9/2008 | Shattil | |
| 7,532,676 | B2 | 5/2009 | Fonseka et al. | |
| 7,639,921 | B2 | 12/2009 | Seo et al. | |
| 7,949,125 | B2 | 5/2011 | Shoval et al. | |
| 8,027,242 | B2 | 9/2011 | Garudadri et al. | |
| 2001/0044722 | A1 * | 11/2001 | Gustafsson et al. | 704/258 |
| 2004/0165680 | A1 | 8/2004 | Kroeger | |
| 2006/0122828 | A1 | 6/2006 | Lee et al. | |
| 2007/0239440 | A1 | 10/2007 | Garudadri et al. | |
| 2009/0177478 | A1 * | 7/2009 | Jax et al. | 704/500 |
| 2009/0198500 | A1 | 8/2009 | Garudadri et al. | |

FOREIGN PATENT DOCUMENTS

| | | | |
|---|---|---|---|
| EP | 1093113 | A2 | 4/2001 |
| EP | 1158494 | A1 | 11/2001 |
| EP | 1852849 | A1 | 11/2007 |
| JP | 62502572 | T | 10/1987 |
| JP | 3127000 | A | 5/1991 |
| JP | 6229234 | A | 8/1994 |
| JP | 7077979 | A | 3/1995 |
| JP | 7234697 | A | 9/1995 |
| JP | 08102945 | | 4/1996 |
| JP | 9258795 | | 10/1997 |
| JP | 2002032100 | A | 1/2002 |
| JP | 2003108196 | A | 4/2003 |
| JP | 2005173607 | A | 6/2005 |
| JP | 2005530206 | A | 10/2005 |
| JP | 2007506986 | T | 3/2007 |
| TW | 172810 | | 11/1991 |
| TW | 405328 | B | 9/2000 |
| TW | 442776 | | 6/2001 |
| TW | 454169 | | 9/2001 |
| TW | 454171 | | 9/2001 |
| TW | 200507467 | | 2/2005 |
| TW | 200529040 | | 9/2005 |
| TW | I242935 | | 11/2005 |
| TW | 200707275 | | 2/2007 |
| TW | 200727729 | | 7/2007 |
| WO | WO03107329 | A1 | 12/2003 |
| WO | WO2005027094 | A1 | 3/2005 |
| WO | WO2005096274 | A1 | 10/2005 |
| WO | WO 2007/128662 | * | 11/2007 |

OTHER PUBLICATIONS

Athineos, Marios et al., "Frequency-Domain Linear Prediction for Temporal Features", Proceeding of ASRU-2003. Nov. 30-Dec. 4, 2003, St. Thomas USVI.

Jesteadt, Walt et al., "Forward Masking as a Function of Frequency, Masker Level and Signal Delay", J. Acoust. Soc. Am., 71(4), Apr. 1982, pp. 950-962.

Motlicek Petr et al., "Wide-Band Perceptual Audio Coding Based on Frequency-Domain Linear Prediction", Proceeding of ICASSP 2007, IEEE Signal Processing Society, Apr. 2007, pp. I-265-I-268.

Motlicek, Petr et al., "Speech Coding Based on Spectral Dynamics". Lecture Notes in Computer Science, vol. 4188/2006. Springer/Berlin/Heidelberg, DE, Sep. 2006.

Christensen, Mads Græsbøll et al., "Computationally Efficient Amplitude Modulated Sinusoidal Audiocoding Using Frequency-Domain Linear Prediction", ICASSP 2006 Proceeding—Toulouse, France, IEEE Signal Processing Society, vol. 5, Issue, May 14-19, 2006 pp. V-V.

Athineos, Marios et al., "PLP2 Autoregressive modeling of auditory-like 2-D spectra-temporal patterns". Proceeding from Workshop n Statistical and Perceptual Audio Processing, SAPA-2004, paper 129, Oct. 3, 2004, Jeju, Korea.

Fousek, Petr, "Doctoral Thesis: Extraction of Features for Automatic Recognition of Speech Based on Spectral Dynamics", Czech Technical University in Prague, Czech Republic, Mar. 2007.

Athineos et al: "LP-TRAP: Linear predictive temporal patterns" Prc. of ICSLP, Oct. 2004, pp. 1154-1157, XP002423398.

De Buda R, et al., "Coherent Demodulation of Frequency-Shift Keying with Low Deviation Ratio," Communications, IEEE Transactions on, vol. 20, No. 3, pp. 429-435, Jun. 1972. doi: 10.1109/TCOM.1972.1091177 URL:http://ieeexplore.ieee.org/stamp/stamp.jsp"tp=&arnumber=1091177&isnumber=23774.

Ephraim Feig, "A fast scaled-DCT algorithm", SPIE vol. 1244, Image Processing Algorithms and Techniques (1990), pp. 2-13.

Hermansky H., Fujisaki H., Sato Y., "Analysis and Synthesis of Speech Based on Spectral Transform Linear Predictive Method", in Proc. of ICASSP, vol. 8, pp. 777-780, Boston, USA, Apr. 1983.

Hermansky H, "Perceptual linear predictive (PLP) analysis for speech", J. Acoust. Soc. Am., vol. 87:4, pp. 1738-1752, 1990.

Herre J et al: "Enhancing the Performance of Perceptual Audio Coders by Using Temporal Noise Shaping (TNS)" Preprints of Papers Presented at the AES Convention, Nov. 8, 1996, pp. 1-24, XP002102636.

International Search Report and Written Opinion—PCT/US2008/074138, International Search Authority—European Patent Office—Nov. 13, 2008.

ISO/IEC JTC1/SC29/WG11 N7335, "Call for Proposals on Fixed-Point 8×8 IDCT and DCT Standard," pp. 1-18, Poznan, Poland, Jul. 2005.

ISO/IEC JTC1/SC29/VVG11 N7817 [23002-2 WD1] "Information technology—MPEG Video Technologies —Part 2: Fixed-point 8×8 IDCT and DCT transforms," Jan. 19, 2006, pp. 1-27.

ISO/IEC JTC1/SC29/WG11N7292 [11172-6 Study on FCD] Information Technology—Coding of Moving Pictures and Associated Audio for Digital Storage Media at up to About 1.5 Mbit/s—Part 6: Specification of Accuracy Requirements for Implementation of Integer Inverse Discrete Cosine Transform, IEEE standard 1180-1190, pp. 1-14, Approved Dec. 6, 1990.

J. Makhoul, "Linear Prediction: A Tutorial Review", in Proc. of IEEE, vol. 63, No. 4, Apr. 1975. pp. 561-580.

Jan Skoglund, et al., "On Time-Frequency Masking in Voiced Speech" IEEE Transactions on Speech and Audio Processing, IEEE Service Center, New York NY, US, vol. 8, No. 4, Jul. 1, 2000, XP011054031.

Johnston J D: "Transform Coding of Audio Signals Using Perceptual Noise Criteria" IEEE Journal on Selected Areas I N. Communications, IEEE Service Center, Piscataway, US, vol. 6, No. 2, Feb. 1, 1988, pp. 314-323, XP002003779.

Kumaresan Ramdas et al: "Model based approach to envelope and positive instantaneous frequency estimation of signals with speech applications" Journal of the Acoustical Society of America, AIP / Acoustical Society of America, Melville, NY, US, vol. 105, No. 3, Mar. 1999, pp. 1912-1924, XP012000860 ISSN: 0001-4966 section B, III p. 1913, left-hand column, lines 3-6.

Loeffler, C., et al., "Algorithm-architecture mapping for custom DCT chips." in Proc. Int. Symp. Circuits Syst. (Helsinki, Finland), Jun. 1988, pp. 1953-1956.

M12984: Gary J. Sullivan, "On the project for a fixed-point IDCT and DCT standard", Jan. 2006, Bankok, Thailand.

M13004: Yuriy A. Reznik, Arianne T. Hinds, Honggang Qi, and Siwei Ma, "On Joint Implementation of Inverse Quantization and IDCT scaling", Jan. 2006, Bankok, Thailand.

M13005, Yuriy A. Reznik, "Considerations for choosing precision of MPEG fixed point 8×8 IDCT Standard" Jan. 2006, Bangkok, Thailand.

Marios Athineos et al., "Autoregressive modeling of temporal envelopes", IEEE Transactions on Signal Processing IEEE Service Center, New York, NY, US—ISSN 1053-587X, Jun. 2007, pp. 1-9, XP002501759.
Mark. S. Vinton and Les. E. Atlas, "A Scalable and Progressive Audio Codec", IEEE ICASSP 2001, May 7-11, 2001, Salt Lake City.
Motlicek et al: "Wide-Band Perceptual Audio Coding based on Frequency-Domain Linear Prediction" IDIAP Research Report, [Online] Oct. 2006, pp. 265-268, XP002423397 Retrieved from the Internet: URL: http://www.idiap.ch/publications/motlicek-idiap-rr-06-58.bib.abs.html.
Motlicek, P. et al, "Audio Coding Based on Long Temporal Contexts," IDIAP Research Report, [Online] Apr. 2006.
Motlicek P., Hermansky H., Garudadri H., "Speech Coding Based on Spectral Dynamics", technical report IDIAP-RR 06-05, <http://www.idiap.ch>, Jan. 2006.
N Derakhshan; MH Savoji. Perceptual Speech Enhancement Using a Hilbert Transform Based Time-Frequency Representation of Speech. SPECOM Jun. 25-29, 2006.
Qin Li; Atlas, L.;, "Properties for modulation spectral filtering," Acoustics, Speech, and Signal Processing, 2005. Proceedings. (ICASSP '05). IEEE International Conference on, vol. 4, No., pp. iv/521-iv/524 vol. 4, Mar. 18-23, 2005 doi: 10.1109/ICASSP.2005.1416060 URL: http://ieeexplore.ieee.org/stamp/stamp.jsp"tp=&arnumber=I4160608isnumber=3065.
Schimmel S., Atlas L., "Coherent Envelope Detector for Modulation Filtering of Speech", in Proc. of ICASSP, vol. 1, pp. 221-224, Philadelphia, USA, May 2005.
Sinaga F, et al., "Wavelet packet based audio coding using temporal masking" Information, Communications and Signal Processing, 2003 and Fourth Pacific RIM Conference on Multimedia. Proceedings of the 2003 Joint Confe Rence of the Fourth International Conference on Singapore Dec. 15-18, 2003, Piscataway, NJ, USA, IEEE, vol. 3, pp. 1380-1383, XP010702139.
Spanias A. S., "Speech Coding: A Tutorial Review", In Proc. of IEEE, vol. 82, No. 10, Oct. 1994.
Sriram Ganapathy, et al., "Temporal masking for bit-rate reduction in audio codec based on Frequency Domain Linear Prediction" Acoustics, Speech and Signal Processing. ICASSP 2008. IEEE International Conference on, IEEE, Piscataway, NJ, USA, Mar. 31, 2008, pp. 4781-4784, XP031251668.
Tyagi V.,"Fepstrum Representation of Speech Signal", Automatic Speech Recognition and Understanding, 2005 IEEE Workshop on, vol., No., pp. 11-16, Nov. 27-27, 2005 doi: 10.1109ASRU.2005.1566475.
W. Chen, C.H. Smith and S.C. Fralick, "A Fast Computational Algorithm for the Discrete Cosine Transform", IEEE Transactions on Communications, vol. com-25, No. 9, pp. 1004-1009, Sep. 1977.
Y.Arai, T. Agui, and M. Nakajima, "A Fast DCT-SQ Scheme for Images", Transactions of the IEICE vol. E 71, No. 11 Nov. 1988, pp. 1095-1097.
Yuriy A, et al., "Proposed Core Experiment (on Exploration) on Convergence of Scaled and Non-Scaled IDCT Architectures", Apr. 1, 2006, Montreux, Switzerland.
Zwicker, et al., "Psychoacoustics Facts and Models," Second Updated Edition with 289 Figures, pp. 78-110, Jan. 1999.
Taiwan Search Report—TW097132397—TIPO—Jun. 8, 2012.

* cited by examiner

SPECTRAL NOISE SHAPING IN AUDIO CODING BASED ON SPECTRAL DYNAMICS IN FREQUENCY SUB-BANDS

CLAIM OF PRIORITY UNDER 35 U.S.C. §119

The present application for patent claims priority to Provisional Application No. 60/957,987 entitled "Spectral Noise Shaping in Audio Coding Based on Spectral Dynamics in Sub-Bands" filed Aug. 24, 2007, and assigned to the assignee hereof and hereby expressly incorporated by reference herein.

REFERENCE TO CO-PENDING APPLICATIONS FOR PATENT

The present application relates to U.S. application Ser. No. 11/696,974, entitled "Processing of Excitation in Audio Coding and Decoding", filed on Apr. 5, 2007, and assigned to the assignee hereof and expressly incorporated by reference herein; and relates to U.S. application Ser. No. 11/583,537, entitled "Signal Coding and Decoding Based on Spectral Dynamics", filed Oct. 18, 2006, and assigned to the assignee hereof and expressly incorporated by reference herein; and relates to U.S. application Ser. No. 12/197,051, entitled "Temporal Masking in Audio Coding Based on Spectral Dynamics in Frequency Sub-Bands", filed Aug. 22, 2008, and assigned to the assignee hereof and expressly incorporated by reference herein.

BACKGROUND

I. Technical Field

This disclosure generally relates to digital signal processing, and more specifically, to techniques for encoding and decoding audio signals for storage and/or communication.

II. Background

In digital communications, signals are typically coded for transmission and decoded for reception. Coding of signals concerns converting the original signals into a format suitable for propagation over a transmission medium. The objective is to preserve the quality of the original signals, but at a low consumption of the medium's bandwidth. Decoding of signals involves the reverse of the coding process.

A known coding scheme uses the technique of pulse-code modulation (PCM). FIG. 1 shows a time-varying signal x(t) that can be a segment of a speech signal, for instance. The y-axis and the x-axis represent the signal amplitude and time, respectively. The analog signal x(t) is sampled by a plurality of pulses 20. Each pulse 20 has an amplitude representing the signal x(t) at a particular time. The amplitude of each of the pulses 20 can thereafter be coded in a digital value for later transmission.

To conserve bandwidth, the digital values of the PCM pulses 20 can be compressed using a logarithmic companding process prior to transmission. At the receiving end, the receiver merely performs the reverse of the coding process mentioned above to recover an approximate version of the original time-varying signal x(t). Apparatuses employing the aforementioned scheme are commonly called the a-law or μ-law codecs.

As the number of users increases, there is a further practical need for bandwidth conservation. For instance, in a wireless communication system, a multiplicity of users are often limited to sharing a finite amount frequency spectrum. Each user is normally allocated a limited bandwidth among other users. Thus, as the number of users increases, so does the need to further compress digital information in order to converse the bandwidth available on the transmission channel.

For voice communications, speech coders are frequently used to compress voice signals. In the past decade or so, considerable progress has been made in the development of speech coders. A commonly adopted technique employs the method of code excited linear prediction (CELP). Details of CELP methodology can be found in publications, entitled "Digital Processing of Speech Signals," by Rabiner and Schafer, Prentice Hall, ISBN: 0132136031, September 1978; and entitled "Discrete-Time Processing of Speech Signals," by Deller, Proakis and Hansen, Wiley-IEEE Press, ISBN: 0780353862, September 1999. The basic principles underlying the CELP method is briefly described below.

Referring to FIG. 1, using the CELP method, instead of digitally coding and transmitting each PCM sample 20 individually, the PCM samples 20 are coded and transmitted in groups. For instance, the PCM pulses 20 of the time-varying signal x(t) in FIG. 1 are first partitioned into a plurality of frames 22. Each frame 22 is of a fixed time duration, for instance 20 ms. The PCM samples 20 within each frame 22 are collectively coded via the CELP scheme and thereafter transmitted. Exemplary frames of the sampled pulses are PCM pulse groups 22A-22C shown in FIG. 1.

For simplicity, take only the three PCM pulse groups 22A-22C for illustration. During encoding prior to transmission, the digital values of the PCM pulse groups 22A-22C are consecutively fed to a linear predictor (LP) module. The resultant output is a set of coefficient and residual values, which basically represents the spectral content of the pulse groups 22A-22C. The LP filter is then quantized.

The LP module generates an approximation of the spectral representation of the PCM pulse groups 22A-22C. As such, during the predicting process, the residual values, or prediction errors, are introduced. The residual values are mapped to a codebook which carries entries of various combinations available for close matching of the coded digital values of the PCM pulse groups 22A-22C. The best fitted values in the codebook are mapped. The mapped values are the values to be transmitted.

Thus, using the CELP method in telecommunications, the encoder (not shown) merely has to generate the coefficients and the mapped codebook values. The transmitter needs only to transmit the coefficients and the mapped codebook values, instead of the individually coded PCM pulse values as in the a- and μ-law encoders mentioned above. Consequently, substantial amount of communication channel bandwidth can be saved.

On the receiver end, it also has a codebook similar to that in the transmitter. The decoder in the receiver, relying on the same codebook, merely has to reverse the encoding process as aforementioned. By also applying the received filter coefficients, the time-varying signal x(t) can be recovered.

Heretofore, many of the known speech coding schemes, such as the CELP scheme mentioned above, are based on the assumption that the signals being coded are short-time stationary. That is, the schemes are based on the premise that frequency contents of the coded frames are stationary and can be approximated by simple (all-pole) filters and some input representation in exciting the filters. Various time domain linear prediction (TDLP) algorithms, in arriving at the codebooks as mentioned above, are based on such a model. Nevertheless, voice patterns among individuals can be very different. Non-speech audio signals, such as sounds emanated from various musical instruments, are also distinguishably different from speech signals. Furthermore, in the CELP process as described above, to expedite real-time signal processing, a short time frame is normally chosen. More specifically, as shown in FIG. 1, to reduce algorithmic delays in the mapping of the values of the PCM pulse groups, such as 22A-22C, to the corresponding entries of vectors in the codebook, a short time window 22 is defined, for example 20 ms as shown in FIG. 1. However, derived spectral or formant information from each frame is mostly common and can be shared among other frames. Consequently, the formant information is more or less repetitively sent through the communication channels, in a manner not in the best interest for bandwidth conservation.

As an improvement over TLDP algorithms, frequency domain linear prediction (FDLP) schemes have been developed to improve preservation of signal quality, applicable not only to human speech, but also to a variety of other sounds, and further, to more efficiently utilize communication channel bandwidth. FDLP-based coding schemes operate by predicting the temporal evolution of spectral envelopes. FDLP is the basically a frequency-domain analogue of TLDP; however, FDLP coding and decoding schemes are capable processing much longer temporal frames when compared to TLDP. Similarly to how TLDP fits an all-pole model to the power spectrum of an input signal, FDLP fits an all-pole model to the squared Hilbert envelope of an input signal.

SUMMARY

Although FDLP represents a significant advance in audio and speech coding techniques, there is need to improve the performance of FDLP codecs. Among other things, it has been found that tonal signals, i.e., signals with impulsive spectral content, cannot be effectively encoded using FDLP without introducing audio artifacts. If an FDLP scheme is used on tonal signals, the quantization noise in encoding the FDLP carrier signal appears as frequency components not present in the input signal. This is referred to herein as the spectral pre-echo problem. In the reconstructed signal, spectral pre-echo is perceived as impulsive noise artifacts occurring with a period equal to a frame duration. In particular, the quantization noise is spread before the onset of the reconstructed signal itself, thus, the term pre-echo is appropriate for this artifact.

Disclosed herein are novel techniques of spectral noise shaping (SNS) designed to address the problem of spectral pre-echo artifacts in FDLP coding schemes.

According to an aspect of the SNS techniques, a method of SNS in audio coding includes processing a tonal audio signal with time domain linear prediction (TDLP) to produce a residual signal and linear predictive coding (LPC) coefficients, and then applying a frequency domain linear prediction (FDLP) process to the residual signal. The LPC coefficients representing a TDLP model and the FDLP encoded residual signal may be efficiently transferred to a decoder for reconstructing the original signal.

According to another aspect of the SNS techniques, an apparatus includes means for TDLP processing a tonal audio signal to produce a residual signal and linear predictive coding (LPC) coefficients, and means for applying a frequency domain linear prediction (FDLP) process to the residual signal.

According to another aspect of the SNS techniques, an apparatus includes a TDLP process configured to produce a residual signal and linear predictive coding (LPC) coefficients in response to a tonal audio signal. The apparatus also includes a frequency domain linear prediction (FDLP) component configured to process the residual signal.

According to another aspect of the SNS techniques, a computer-readable medium, embodying a set of instructions executable by one or more processors, includes code for TDLP processing a tonal audio signal to produce a residual signal and linear predictive coding (LPC) coefficients representing a TDLP model, and code for applying a frequency domain linear prediction (FDLP) process to the residual signal.

Other aspects, features, embodiments and advantages of the audio coding technique will be or will become apparent to one with skill in the art upon examination of the following figures and detailed description. It is intended that all such additional features, embodiments, processes and advantages be included within this description and be protected by the accompanying claims.

BRIEF DESCRIPTION OF THE DRAWINGS

It is to be understood that the drawings are solely for purpose of illustration. Furthermore, the components in the figures are not necessarily to scale, emphasis instead being placed upon illustrating the principles of the disclosed audio coding technique. In the figures, like reference numerals designate corresponding parts throughout the different views.

DETAILED DESCRIPTION

Figure 1:
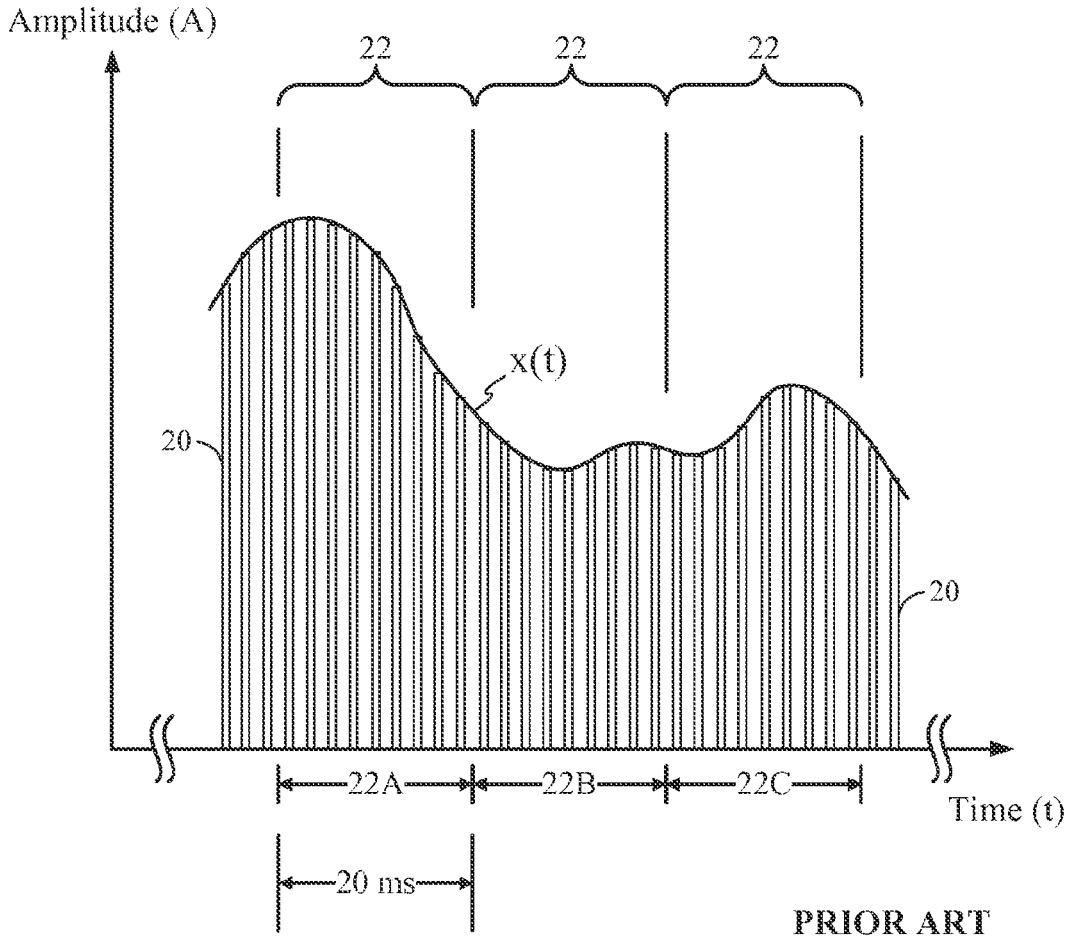
FIG. 1 shows a graphical representation of a time-varying signal sampled into a discrete signal.

The following detailed description, which references to and incorporates the drawings, describes and illustrates one or more specific embodiments. These embodiments, offered not to limit but only to exemplify and teach, are shown and described in sufficient detail to enable those skilled in the art to practice what is claimed. Thus, for the sake of brevity, the description may omit certain information known to those of skill in the art.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make and use the invention, and not necessarily to limit the scope of legal protection afforded the appended claims.

In this specification and the appended claims, unless specifically specified wherever appropriate, the term "signal" is broadly construed. Thus the term signal may refer to either continuous or discrete signals, and further, to either frequency-domain or time-domain signals. In addition, the term "frequency transform" and "frequency-domain transform" are used interchangeably. Likewise, the term "time transform" and "time-domain transform" are used interchangeably.

The techniques disclosed herein address the problem of spectral pre-echo in codecs that model information based on spectral dynamics in frequency sub-bands. Specifically, when an FDLP codec is used to compress a tonal signal, quantization noise appears in frequencies not present in the original input signal. Spectral pre-echo manifests in quantization error of the FDLP carrier signal. If a sub-band frequency signal is tonal, the error in the quantization of the FDLP carrier spreads across all the frequencies around the tone. This results in an impairment of the reconstructed signal in the form of the framing artifacts lasting a frame duration.

To address the spectral pre-echo problem, the SNS techniques disclosed herein recognize that tonal signals are temporally predictable using TDLP, and the residual of such prediction can be efficiently processed using an FDLP codec. By sending minimum amount of additional information (e.g., LPC coefficients representing a TDLP model), the quantization noise at the receiver can be shaped in the frequency domain according to the spectral characteristics of the input signal. This shaping is accomplished by an inverse TDLP process applied at the decoder.

Thus, an SNS technique, added to an FDLP codec, allows for successfully encoding both types of extreme signals:

1. For transient and time-impulsive signals, linear prediction in the frequency domain (FDLP) tracks the temporal variation in the signal.

2. For tonal signals, the SNS processing block shapes the quantization noise according to the power spectral density (PSD) of the input signal.

The coding techniques described herein adapt the time-frequency resolution of analysis according to the input signal.

Briefly, frequency decomposition of the input audio signal is employed to obtain multiple frequency sub-bands that closely follow critical decomposition. Then, in each sub-band, a so-called analytic signal is pre-computed and the squared magnitude of the analytic signal is transformed using a discrete Fourier transform (DFT), and then linear prediction is applied resulting in a Hilbert envelope and a Hilbert Carrier for each of the sub-bands. Because of employment of linear prediction of frequency components, the technique is called Frequency Domain Linear Prediction (FDLP). The Hilbert envelope and the Hilbert Carrier are analogous to spectral envelope and excitation signals in the Time Domain Linear Prediction (TDLP) techniques. The concept of forward masking may be applied to the encoding of sub-band Hilbert carrier signals. By doing this, the bit-rate of an FDLP codec may be substantially reduced without significantly degrading signal quality. Spectral noise shaping (SNS) is applied to improve the performance of the FDLP codec.

Generally, the FDLP coding scheme is based on processing long (hundreds of ms) temporal segments. A full-band input signal is decomposed into sub-bands using QMF analysis. In each sub-band, FDLP is applied and line spectral frequencies (LSFs) representing the sub-band Hilbert envelopes are quantized. The residuals (sub-band carriers) are processed using DFT and corresponding spectral parameters are quantized. In the decoder, spectral components of the sub-band carriers are reconstructed and transformed into time-domain using inverse DFT. The reconstructed FDLP envelopes (from LSF parameters) are used to modulate the corresponding sub-band carriers. Finally, the inverse QMF block is applied to reconstruct the full-band signal from frequency sub-bands.

Figure 2:
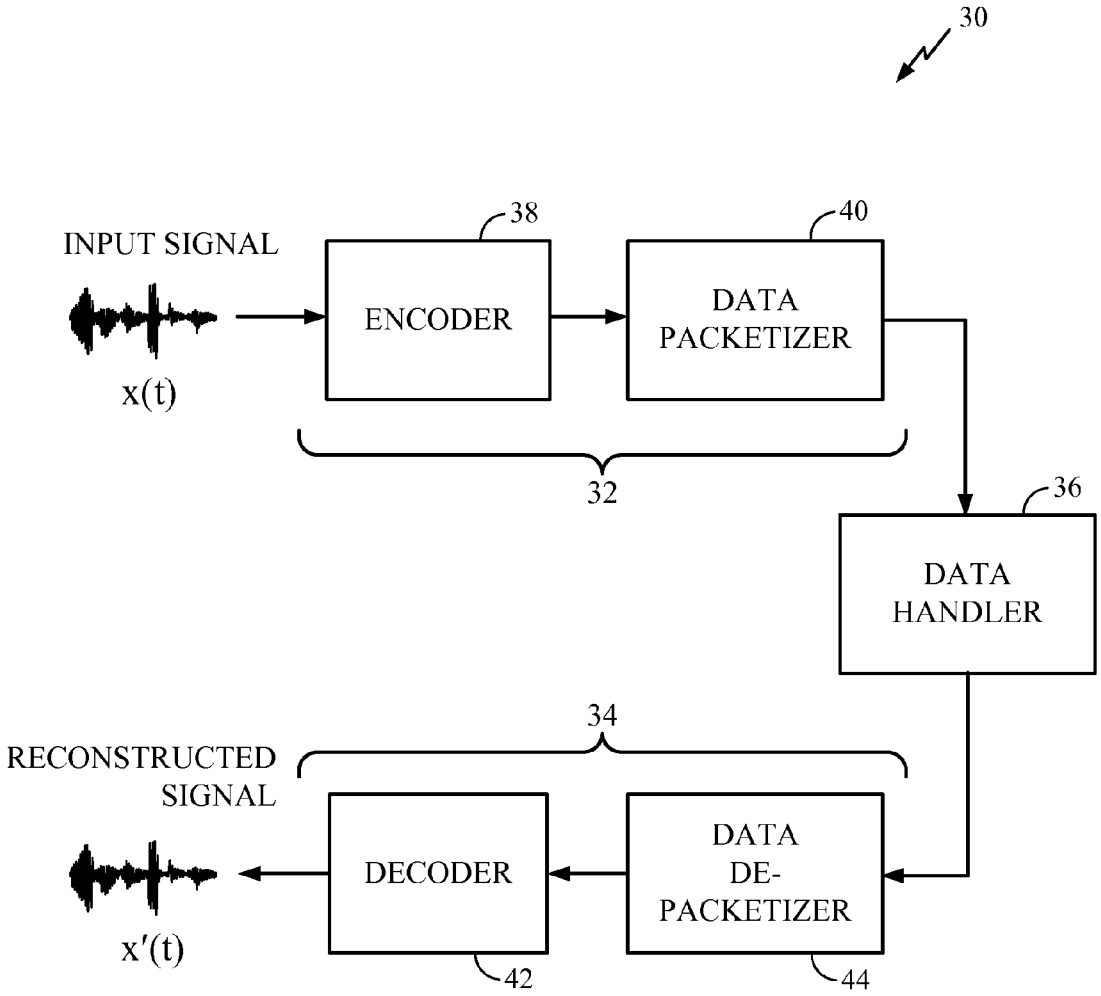
FIG. 2 is a generalized block diagram illustrating a digital system for encoding and decoding signals.

Turning now to the drawings, and in particular to FIG. 2, there is a generalized block diagram illustrating a digital system 30 for encoding and decoding signals. The system 30 includes an encoding section 32 and a decoding section 34. Disposed between the sections 32 and decoder 34 is a data handler 36. Examples of the data handler 36 can be a data storage device and/or a communication channel.

In the encoding section 32, there is an encoder 38 connected to a data packetizer 40. The encoder 38 implements an FDLP technique for encoding input signals as described herein. The packetizer 40 formats and encapsulates an encoded input signal and other information for transport through the data handler 36. A time-varying input signal x(t), after being processed through the encoder 38 and the data packetizer 40 is directed to the data handler 36.

In a somewhat similar manner but in the reverse order, in the decoding section 34, there is a decoder 42 coupled to a data de-packetizer 44. Data from the data handler 36 are fed to the data de-packetizer 44 which in turn sends the de-packetized data to the decoder 42 for reconstruction of the original time-varying signal x(t). The reconstructed signal is represented by x'(t). The de-packetizer 44 extracts the encoded input signal and other information from incoming data packets. The decoder 42 implements an FDLP technique for decoding the encoded input signal as described herein.

The encoding section 32 and decoding section 34 may each be included in a separate wireless communication device (WCD), such as a cellular phone, personal digital assistant (PDA), wireless-enabled computer, such as a laptop, or the like. The data handler 36 may include a wireless link, such as those found in a CDMA communication system.

Figure 3:
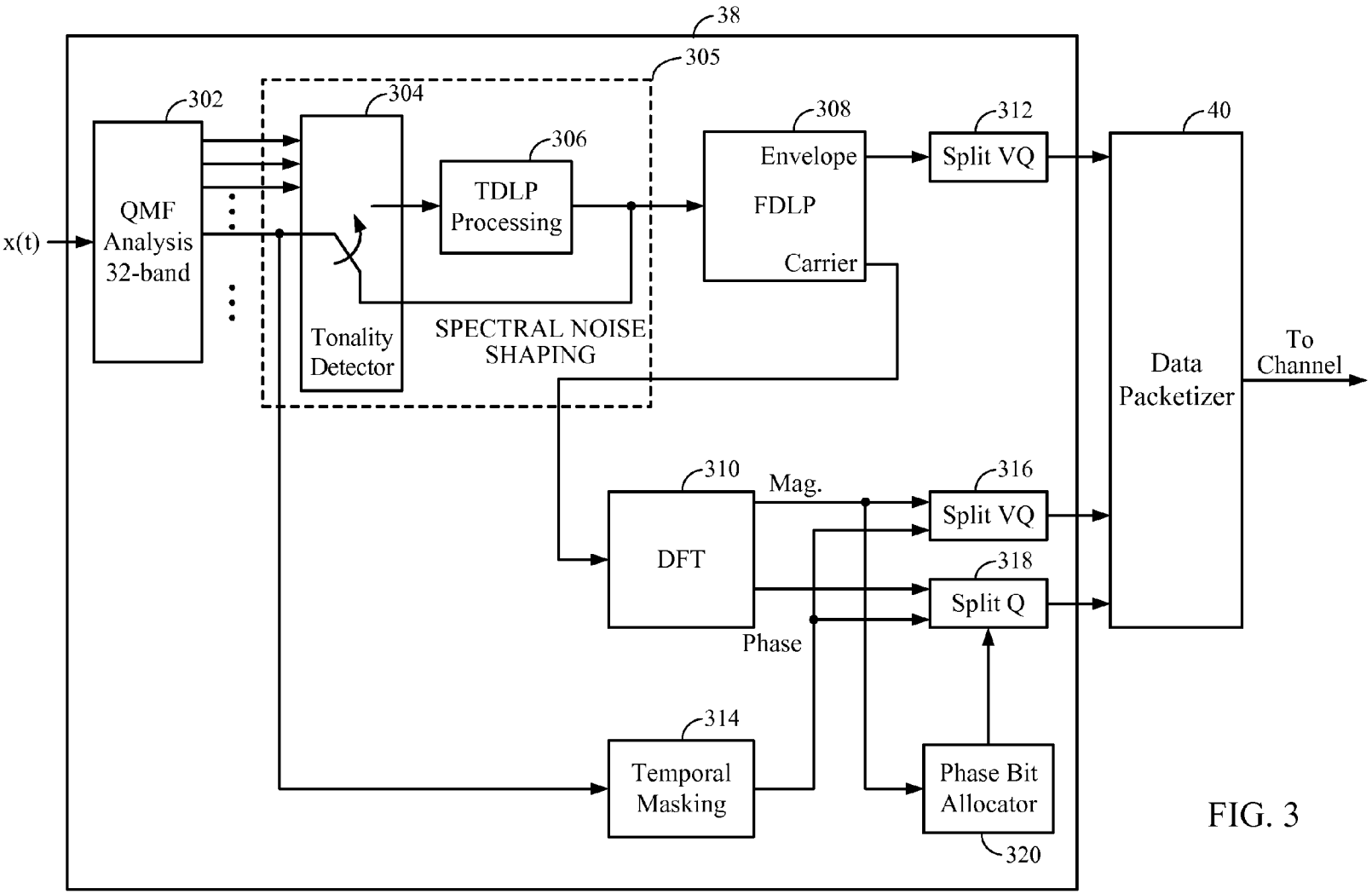
FIG. 3 is a conceptual block diagram illustrating certain components of an FDLP digital encoder using spectral noise shaping (SNS), which may be included in the system of FIG. 2.

FIG. 3 is a conceptual block diagram illustrating certain components of an exemplary FDLP-type encoder 38 using SNS, which may be included in the system 30 of FIG. 2. The encoder 38 includes a quadrature mirror filter (QMF) 302, a tonality detector 304, a time-domain linear prediction (TDLP) component 306, a frequency-domain linear prediction (FDLP) component 308, a discrete Fourier transform (DFT) component 310, a first split vector quantizer (VQ) 312, a second split vector quantizer (VQ) 316, a scalar quantizer 318, a phase-bit allocator 320, and a temporal mask 314. One exemplary SNS 305 may be comprised of the tonality detector 304 and the TDLP component 306. The encoder 38 receives a time-varying, continuous input signal x(t), which may be an audio signal. The time-varying input signal is sampled into a discrete input signal. The discrete input signal is then processed by the above-listed components 302-320 to generate encoder outputs. The outputs of the encoder 38 are packetized and manipulated by the data packetizer 40 into a format suitable for transport over a communication channel or other data transport media to a recipient, such as a device including the decoding section 34.

Figure 4:
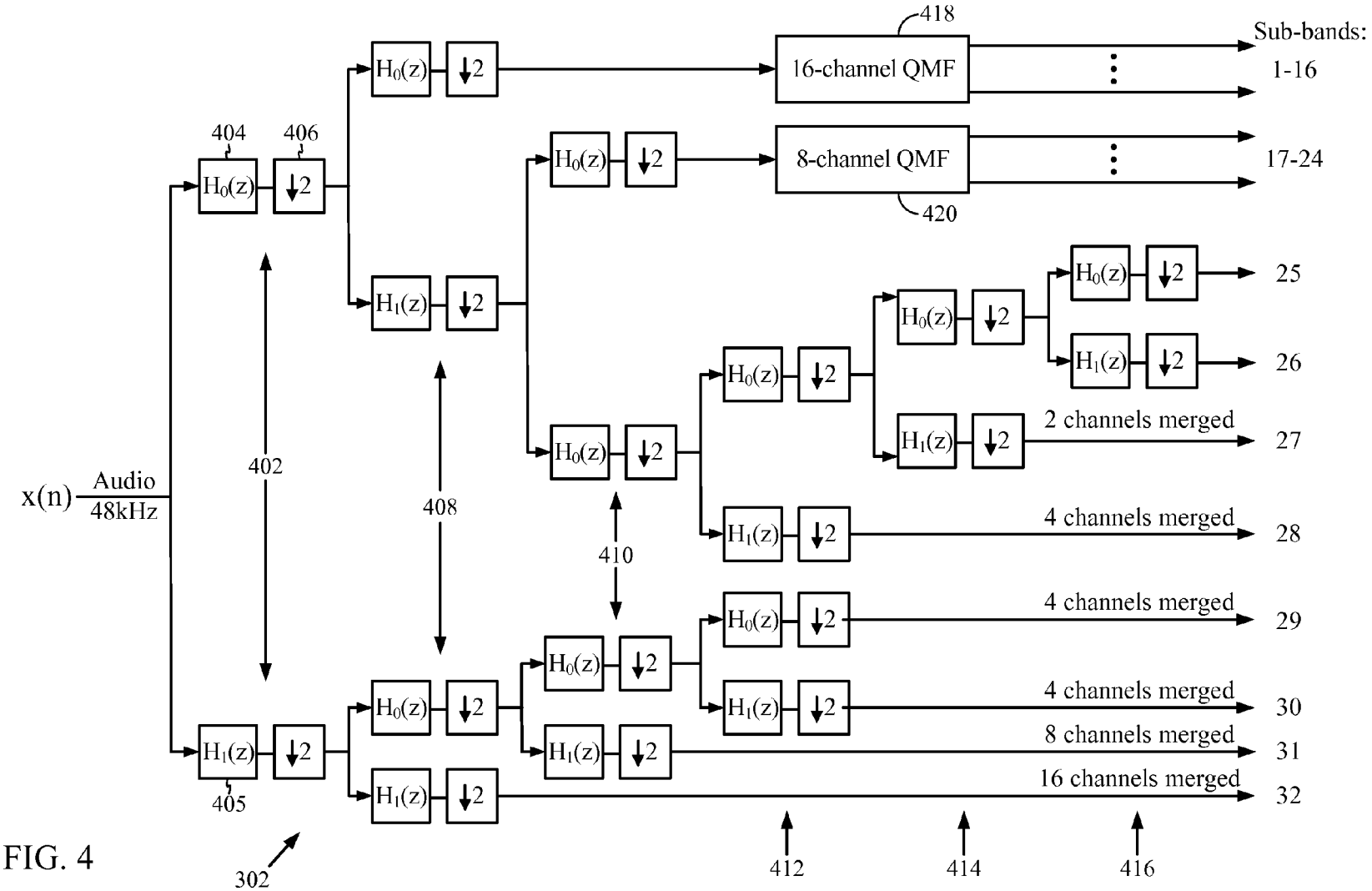
FIG. 4 is a conceptual block diagram illustrating details of the QMF analysis component shown in FIG. 3.

The QMF 302 performs a QMF analysis on the discrete input signal. Essentially, the QMF analysis decomposes the discrete input signal into thirty-two non-uniform, critically sampled sub-bands. For this purpose, the input audio signal is first decomposed into sixty-four uniform sub-bands using a uniform QMF decomposition. The sixty-four uniform QMF sub-bands are then merged to obtain the thirty-two non-uniform sub-bands. An FDLP codec based on uniform QMF decomposition producing the sixty-four sub-bands may operate at about 130 kbps. The QMF filter bank can be implemented in a tree-like structure, e.g., a six stage binary tree. The merging is equivalent to tying some branches in the binary tree at particular stages to form the non-uniform bands. This tying may follow the human auditory system, i.e., more bands at higher frequencies are merged together than at the lower frequencies since the human ear is generally more sensitive to lower frequencies. Specifically, the sub-bands are narrower at the low-frequency end than at the high-frequency end. Such an arrangement is based on the finding that the sensory physiology of the mammalian auditory system is more attuned to the narrower frequency ranges at the low end than the wider frequency ranges at the high end of the audio frequency spectrum. A graphical schematic of perfect reconstruction non-uniform QMF decomposition resulting from an exemplary merging of the sixty-four sub-bands into thirty-two sub-bands is shown in FIG. 4.

Each of the thirty-two sub-bands output from the QMF 302 is provided to the tonality detector 304. The tonality detector applies a technique of spectral noise shaping (SNS) to overcome spectral pre-echo. Spectral pre-echo is a type of undesirable audio artifact that occurs when tonal signals are encoded using an FDLP codec. As is understood by those of ordinary skill in the art, a tonal signal is one that has strong impulses in the frequency domain. In an FDLP codec, tonal sub-band signals can cause errors in the quantization of an FDLP carrier that spread across the frequencies around the tone. In the reconstructed audio signal output by an FDLP decoder, this appears as an audio framing artifacts occurring with the period of a frame duration. This problem is referred to as spectral pre-echo.

To reduce or eliminate the problem of spectral pre-echo, the tonality detector 304 can check each sub-band signal before it is processed by the FDLP component 308. If a sub-band signal is identified as tonal, it is passed through the TDLP component 306. If not, the non-tonal sub-band signal is passed directly to the FDLP component 308 without TDLP component.

Since tonal signals are highly predictable in the time domain, the residual of the time-domain linear prediction (the TDLP process output) of a tonal sub-band signal has frequency characteristics that can be efficiently modeled by the FDLP component 308. Thus, for a tonal sub-band signal, the FDLP encoded TDLP residual of the sub-band signal is output from the encoder 38 along with TDLP parameters of an all pole filter (LPC coefficients) for the sub-band. At the receiver, inverse-TDLP process is applied on the FDLP-decoded sub-band signal, using the transported LPC coefficients, to reconstruct the sub-band signal. Further details of the decoding process are described below in connection with FIGS. 5 and 8.

The FDLP component 308 processes each sub-band in turn. Specifically, the sub-band signal is predicted in the frequency domain and the prediction coefficients form the Hilbert envelope. The residual of the prediction forms the Hilbert carrier signal. The FDLP component 308 splits an incoming sub-band signal into two parts: an approximation part represented by the Hilbert envelope coefficients and an error in approximation represented by the Hilbert carrier. The Hilbert envelope is quantized in the line spectral frequency (LSF) domain by the FDLP component 308. The Hilbert carrier is passed to the DFT component 310, where it is encoded into the DFT domain.

The line spectral frequencies (LSFs) correspond to an auto-regressive (AR) model of the Hilbert carrier and are computed from the FDLP coefficients. The LSFs are vector quantized by the first split VQ 312. A $40^{th}$-order all-pole model may be used by the first split VQ 312 to perform the split quantization.

The DFT component 310 receives the Hilbert carrier from the FDLP component 308 and outputs a DFT magnitude signal and DFT phase signal for each sub-band Hilbert carrier. The DFT magnitude and phase signals represent the spectral components of the Hilbert carrier. The DFT magnitude signal is provided to the second split VQ 316, which performs a vector quantization of the magnitude spectral components. Since a full-search VQ would likely be computationally infeasible, a split VQ approach is employed to quantize the magnitude spectral components. The split VQ approach reduces computational complexity and memory requirements to manageable limits without severely affecting the VQ performance. To perform split VQ, the vector space of spectral magnitudes is divided into separate partitions of lower dimension. The VQ codebooks are trained (on a large audio database) for each partition, across all the frequency sub-bands, using the Linde-Buzo-Gray (LBG) algorithm. The bands below 4 kHz have a higher resolution VQ codebook, i.e., more bits are allocated to the lower sub-bands, than the higher frequency sub-bands.

The scalar quantizer 318 performs a non-uniform scalar quantization (SQ) of DFT phase signals corresponding to the Hilbert carriers of the sub-bands. Generally, the DFT phase components are uncorrelated across time. The DFT phase components have a distribution close to uniform, and therefore, have high entropy. To prevent excessive consumption of bits required to represent DFT phase coefficients, those corresponding to relatively low DFT magnitude spectral components are transmitted using lower resolution SQ, i.e., the codebook vector selected from the DFT magnitude codebook is processed by adaptive thresholding in the scalar quantizer 318. The threshold comparison is performed by the phase bit-allocator 320. Only the DFT spectral phase components whose corresponding DFT magnitudes are above a predefined threshold are transmitted using high resolution SQ. The threshold is adapted dynamically to meet a specified bit-rate of the encoder 38.

The temporal mask 314 is applied to the DFT phase and magnitude signals to adaptively quantize these signals. The temporal mask 314 allows the audio signal to be further compressed by reducing, in certain circumstances, the number of bits required to represent the DFT phase and magnitude signals. The temporal mask 314 includes one or more threshold values that generally define the maximum level of noise allowed in the encoding process so that the audio remains perceptually acceptable to users. For each sub-band frame processed by the encoder 38, the quantization noise introduced into the audio by the encoder 38 is determined and compared to a temporal masking threshold. If the quantization noise is less than the temporal masking threshold, the number of quantization levels of the DFT phase and magnitude signals (i.e., number of bits used to represent the signals)

is reduced, thereby increasing the quantization noise level of the encoder 38 to approach or equal the noise level indicated by the temporal mask 314. In the exemplary encoder 38, the temporal mask 314 is specifically used to control the bit-allocation for the DFT magnitude and phase signals corresponding to each of the sub-band Hilbert carriers.

The application of the temporal mask 314 may be done in the specific following manner. An estimation of the mean quantization noise present in the baseline codec (the version of the codec where there is no temporal masking) is performed for each sub-band sub-frame. The quantization noise of the baseline codec may be introduced by quantizing the DFT signal components, i.e., the DFT magnitude and phase signals output from the DFT component 310, and are preferably measured from these signals. The sub-band sub-frames may be 200 milliseconds in duration. If the mean of the quantization noise in a given sub-band sub-frame is above the temporal masking threshold (e.g., mean value of the temporal mask), no bit-rate reduction is applied to the DFT magnitude and phase signals for that sub-band frame. If the mean value of the temporal mask is above the quantization noise mean, the amount of bits needed to encode the DFT magnitude and phase signals for that sub-band frame (i.e., the split VQ bits for DFT magnitude and SQ bits for DFT phase) is reduced in by an amount so that the quantization noise level approaches or equals the maximum permissible threshold given by the temporal mask 314.

The amount of bit-rate reduction is determined based on the difference in dB sound pressure level (SPL) between the baseline codec quantization noise and the temporal masking threshold. If the difference is large, the bit-rate reduction is great. If the difference is small, the bit-rate reduction is small.

The temporal mask 314 configures the second split VQ 316 and SQ 318 to adaptively effect the mask-based quantizations of the DFT phase and magnitude parameters. If the mean value of the temporal mask is above the noise mean for a given sub-band sub-frame, the amount of bits needed to encode the sub-band sub-frame (split VQ bits for DFT magnitude parameters and scalar quantization bits for DFT phase parameter) is reduced in such a way that the noise level in a given sub-frame (e.g. 200 milliseconds) may become equal (in average) to the permissible threshold (e.g., mean, median, rms) given by the temporal mask. In the exemplary encoder 38 disclosed herein, eight different quantizations are available so that the bit-rate reduction is at eight different levels (in which one level corresponds to no bit-rate reduction).

Information regarding the temporal masking quantization of the DFT magnitude and phase signals is transported to the decoding section 34 so that it may be used in the decoding process to reconstruct the audio signal. The level of bit-rate reduction for each sub-band sub-frame is transported as side information along with the encoded audio to the decoding section 34.

FIG. 4 is a conceptual block diagram illustrating details of the QMF 302 in FIG. 3. The QMF 302 decomposes the full-band discrete input signal (e.g., an audio signal sampled at 48 kHz) into thirty-two non-uniform, critically sampled frequency sub-bands using QMF analysis that is configured to follow the auditory response of the human ear. The QMF 302 includes a filter bank having six stages 402-416. To simplify FIG. 4, the final four stages of sub-bands 1-16 are generally represented by a 16-channel QMF 418, and the final three stages of sub-bands 17-24 are generally represented by an 8-channel QMF 420. Each branch at each stage of the QMF 302 include either a low-pass filter $H_0(z)$ 404 or a high-pass filter $H_1(z)$ 405. Each filter is followed by a decimator $\downarrow 2$ 406 configured to decimate the filtered signal by a factor of two.

Figure 5:
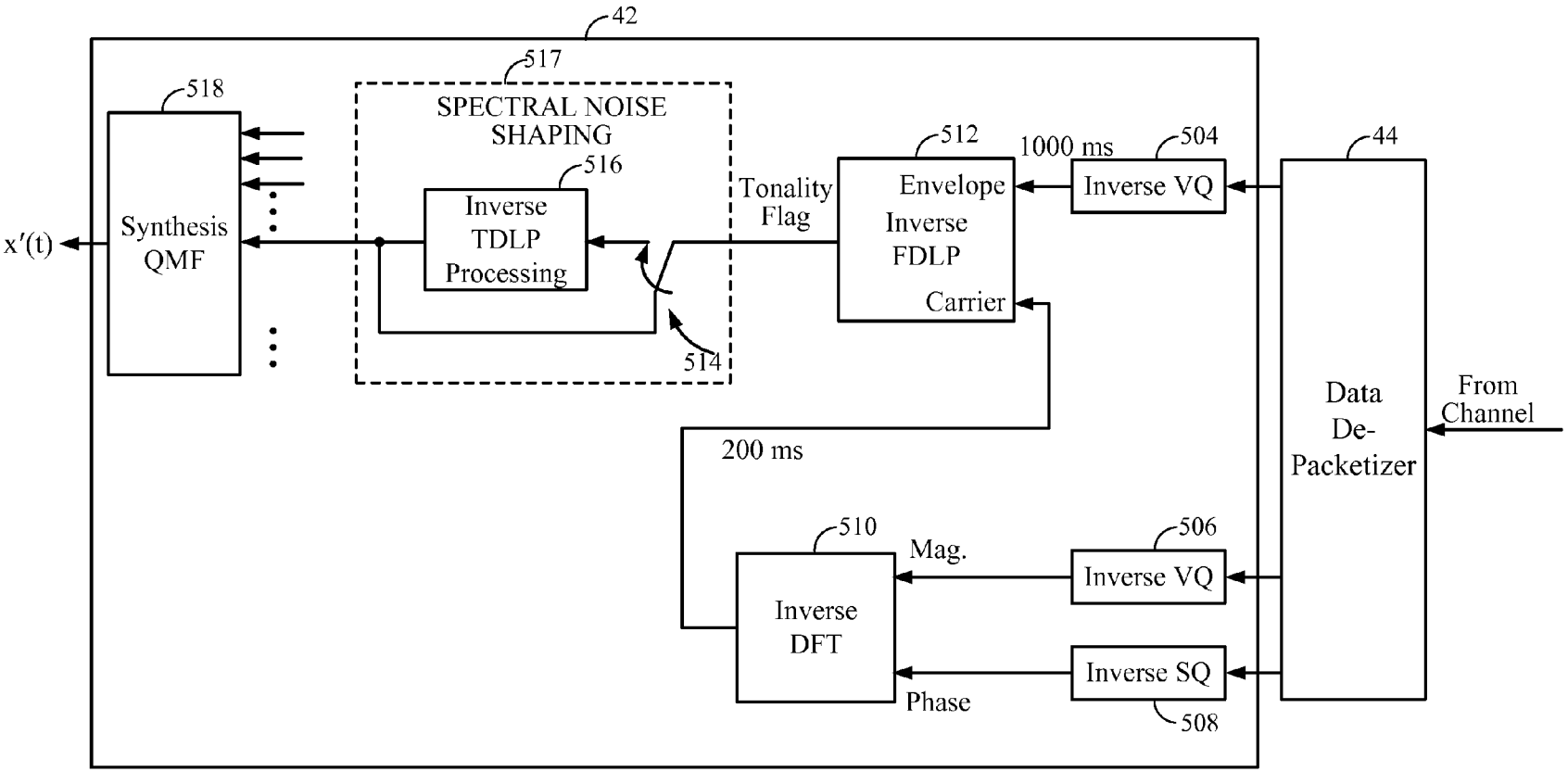
FIG. 5 is a conceptual block diagram illustrating certain components of an FDLP digital decoder using SNS, which may be included in the system of FIG. 2.

FIG. 5 is a conceptual block diagram illustrating certain components of an FDLP-type decoder 42, which may be included in the system 30 of FIG. 2. The data de-packetizer 44 de-encapsulates data and information contained in packets received from the data handler 36, and then passes the data and information to the encoder 42. The information includes at least a tonality flag for each sub-band frame and temporal masking quantization value(s) for each sub-band sub-frame. The tonality flag can be a single bit value corresponding to each sub-band frame.

The components of the decoder 42 essentially perform the inverse operation of those included in the encoder 38. The decoder 42 includes a first inverse vector quantizer (VQ) 504, a second inverse VQ 506, and an inverse scalar quantizer (SQ) 508. The first inverse split VQ 504 receives encoded data representing the Hilbert envelope, and the second inverse split VQ 506 and inverse SQ 508 receive encoded data representing the Hilbert carrier. The decoder 42 also includes an inverse DFT component 510, and inverse FDLP component 512, a tonality selector 514, an inverse TDLP component 516, and a synthesis QMF 518.

For each sub-band, received vector quantization indices for LSFs corresponding to Hilbert envelope are inverse quantized by the first inverse split VQ 504. The DFT magnitude parameters are reconstructed from the vector quantization indices that are inverse quantized by the second inverse split VQ 506. DFT phase parameters are reconstructed from scalar values that are inverse quantized by the inverse SQ 508. The temporal masking quantization value(s) are applied by the second inverse split VQ 506 and inverse SQ 508. The inverse DFT component 510 produces the sub-band Hilbert carrier in response to the outputs of the second inverse split VQ 506 and inverse SQ 508. The inverse FDLP component 512 modulates the sub-band Hilbert carrier using reconstructed Hilbert envelope.

The tonality flag is provided to tonality selector 514 in order to allow the selector 514 to determine whether inverse TDLP process should be applied. If the sub-band signal is tonal, as indicated by the flag transmitted from the encoder 38, the sub-band signal (i.e., the LPC coefficients and FDLP-decoded TDLP residual signal) is sent to the inverse TDLP component 516 for inverse TDLP processing prior to QMF synthesis. If not, the sub-band signal bypasses the inverse TDLP component 516 to the synthesis QMF 518. The exemplary SNS 517 may be comprised of the inverse TDLP component 516 and tonality selector 514.

The synthesis QMF 518 performs the inverse operation of the QMF 302 of the encoder 38. All sub-bands are merged to obtain the full-band signal using QMF synthesis. The discrete full-band signal is converted to a continuous signal using appropriate D/A conversion techniques to obtain the time-varying reconstructed continuous signal x'(t).

Figure 6A:
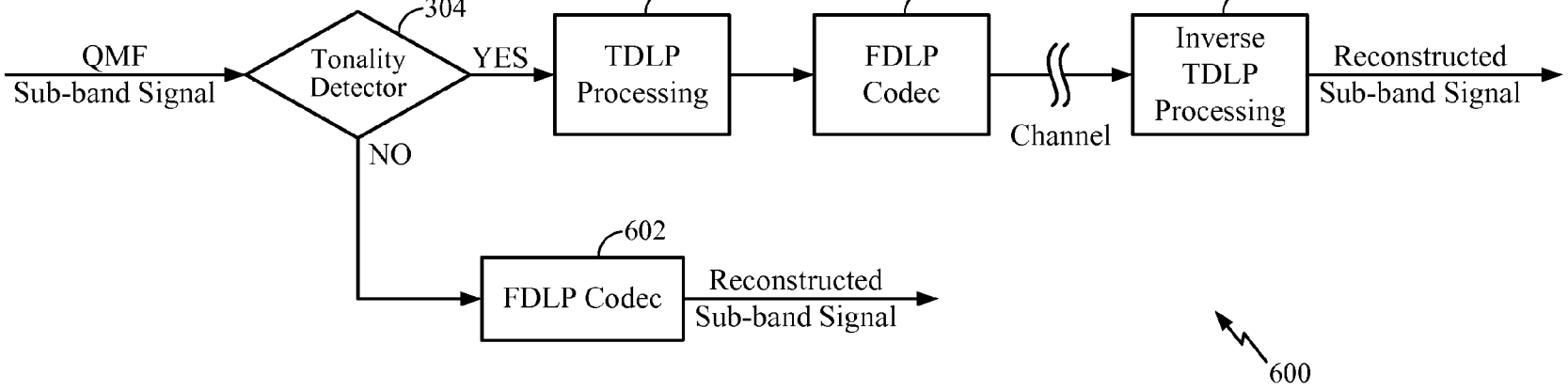
FIG. 6A is a process flow diagram illustrating SNS processing of tonal and non-tonal signals by the digital system of FIG. 2.

FIG. 6A is a process flow diagram 600 illustrating SNS processing of tonal and non-tonal signals by the digital system 30 of FIG. 2. For each sub-band signal output from the QMF 302, the tonality detector 304 determines whether the sub-band signal is tonal. As discussed above in connection with FIG. 3, a tonal signal is one that has strong impulses in the frequency domain. Thus, the tonality detector 314 may apply a frequency-domain transformation, e.g., discrete cosine transform (DCT), to each sub-band signal to determine its frequency components. The tonality detector 314 then determines the harmonic content of the sub-band, and if the harmonic content exceeds a predetermined threshold, the sub-band is declared tonal. A tonal time-domain sub-band signal is then provided to the TDLP component 306 and processed therein as described above in connection with FIG.

3. The residual signal output of the TDLP component 306 is provided to an FDLP codec 602, which may include components 308-320 of the decoder 38 and components 504-516 of decoder 42. The output of the FDLP codec 602 is provided to the inverse TDLP component 516, which in turn produces a reconstructed sub-band signal.

A non-tonal sub-band signal is provided directly to the FDLP codec 602, bypassing the TDLP component 306; and the output of the FDLP codec 602 represents the reconstructed sub-band signal, without any further processing by the inverse TDLP component 516.

Figure 6B:
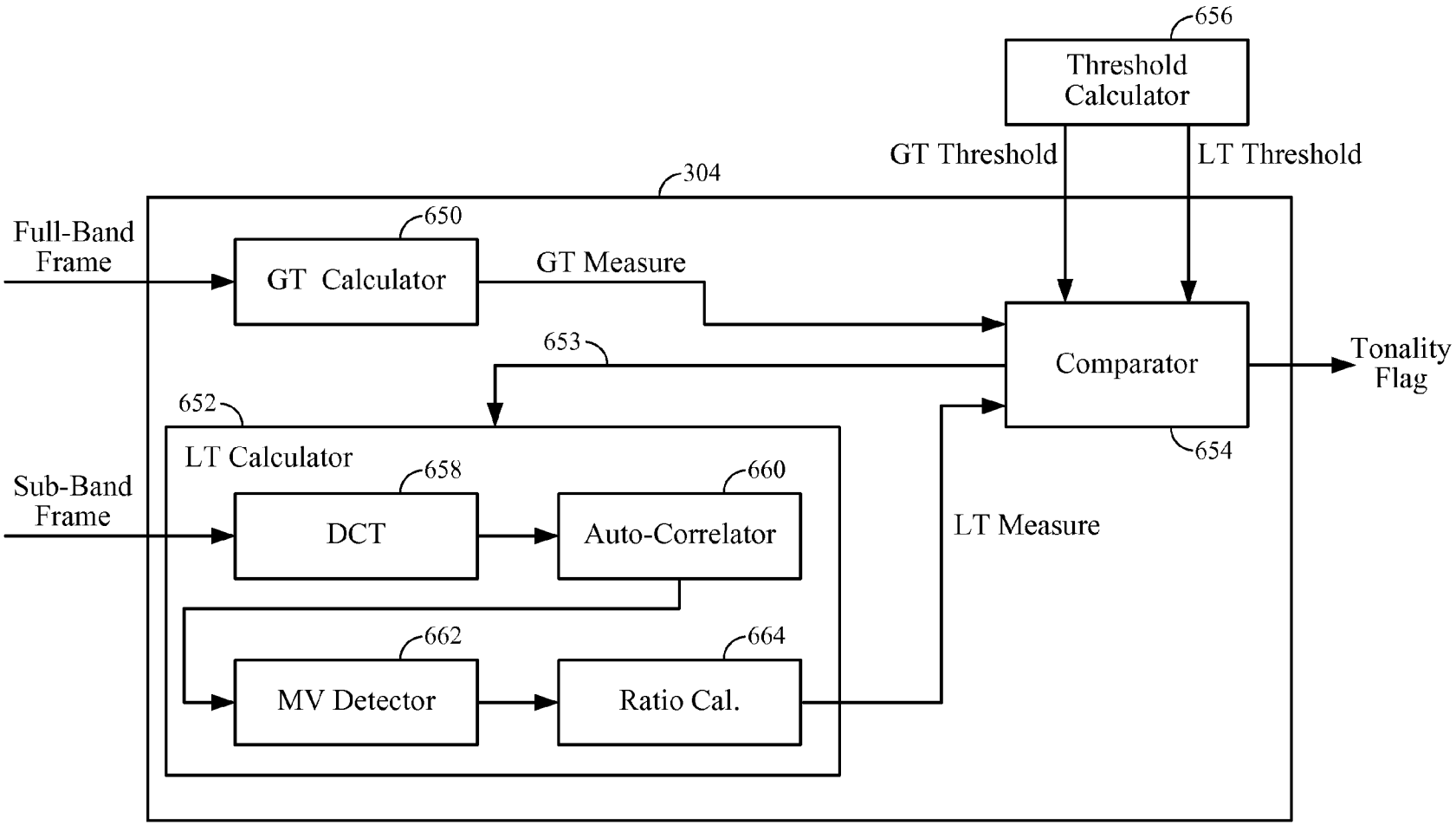
FIG. 6B is a conceptual block diagram illustrating certain components of the tonality detector.

FIG. 6B is a conceptual block diagram illustrating certain components of the exemplary tonality detector 304. The tonality detector 304 includes a global tonality (GT) calculator 650 configured to determine global tonality measure, a local tonality (LT) calculator 652 configured to determine a local tonality measure, and a comparator 654 configured to determine whether the audio signal is tonal based on the global and local tonality measures. The comparator 654 outputs the tonality flag, which when set, indicates that the sub-band currently being checked is tonal.

The GT measure is based on a spectral flatness measure (SFM) computed over a frame of full-band audio. As is understood by those of ordinary skill in the art, the SFM may be calculated by dividing the geometric mean of the power spectrum of the frame by the arithmetic mean of the power spectrum of the frame. The full-band audio includes all of the sub-band frequencies in a frame. The comparator 654 is configured to compare the SFM to a GT threshold and to declare the audio frame to be non-tonal, if the SFM is above the GT threshold. The LT calculator 652 is configured to compute the LT measure of each of the frequency sub-bands of the frame (i.e., search the sub-band frequencies for tonal sub-bands), only if the SFM is below the GT threshold. The comparator 654 instructs the LT calculator 652 to search the sub-bands for tonal signals via control signal 653.

The LT calculator 652 includes a DCT calculator 658 configured to compute a discrete cosine transform (DCT) of each sub-band frame; an auto-correlator 660 configured to compute a plurality of auto-correlation values from the DCT; a maximum value (MV) detector 662 configured to determine a maximum auto-correlation value from the auto-correlation values; and a ratio calculator 664 configured to compute the ratio of the maximum auto-correlation value to the energy of the DCT. The LT measure is based on the ratio determined by the ratio calculator 664.

The LT measure is based on measuring the modeling capability of the FDLP for a particular sub-band signal. This is determined from the auto-correlation of the DCT of the sub-band signal (the DCT may also be used for estimation of FDLP envelopes). The ratio of the maximum auto-correlation value (within the FDLP AR model order) to the energy of the DCT (zeroth lag of auto-correlation) is used as the LT measure. If the sub-band signal is highly tonal, its DCT is impulsive and therefore, the auto-correlation of the DCT is impulsive, too. On the other hand, if the higher lags of auto-correlation (within the FDLP model order) contain a considerable percentage of the energy (zeroth lag of auto-correlation), the DCT of the signal is predictable and the FDLP codec is able to encode them efficiently.

Figure 14:
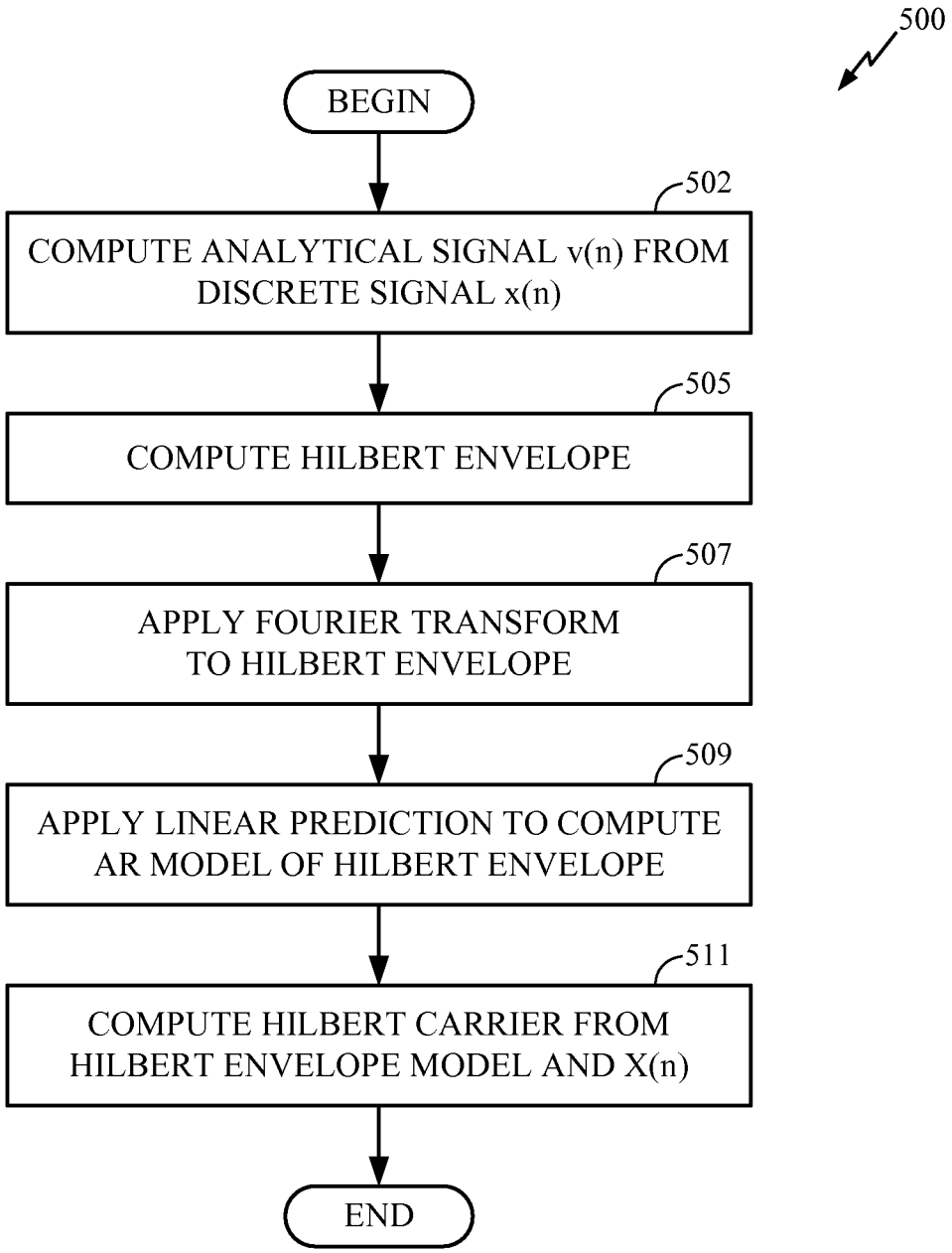
FIG. 14 is a flowchart illustrating a method of estimating a Hilbert envelope in an FDLP encoding process.

Alternatively, the DCT of each sub-band frame and the auto-correlation values can be obtained from the FDLP component 308, which computes these values for each sub-band during FDLP processing, as described herein in connection with FIGS. 7 and 14.

The LT measure for each sub-band is provided to the comparator 654, where it is compared to the LT threshold. If a sub-band's LT measure is below the LT threshold, the comparator 654 sets the tonality flag corresponding to the sub-band. Otherwise, the tonality flag is not set.

A threshold calculator 656 is configured to provide a GT threshold and an LT threshold, each for comparison with the GT measure and LT measure, respectively. The GT threshold and the LT threshold may each be determined empirically based on listening tests. For example, the values for these thresholds may be obtained using Perceptual Evaluation of Audio Quality (PEAQ) scores and listening tests. This may result in a GT threshold fixed at 30% and an LT measure fixed at 10%.

Figure 6C:
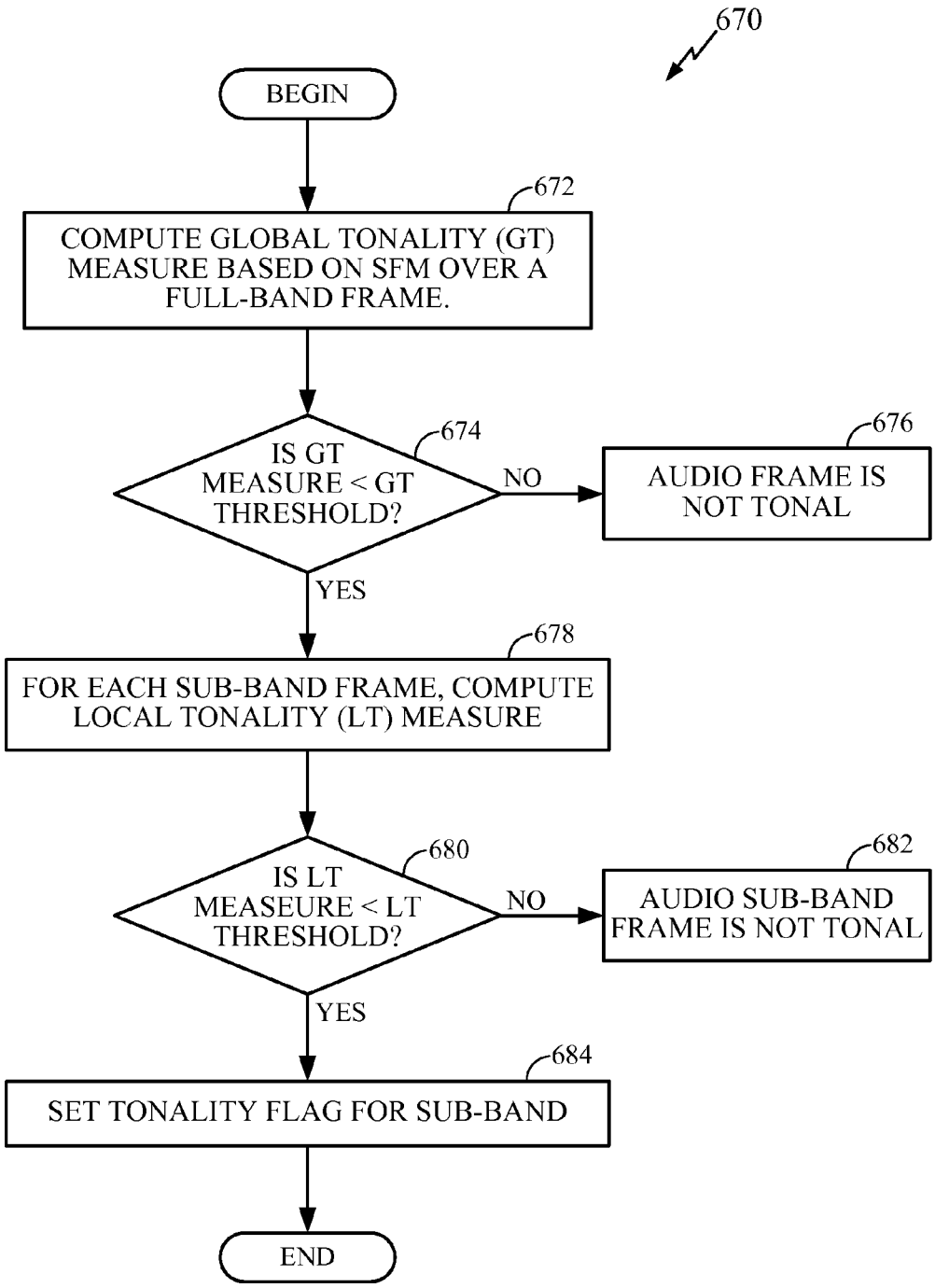
FIG. 6C is a flowchart illustrating a method of determining the tonality of an audio signal.

FIG. 6C is a flowchart 670 illustrating a method of determining the tonality of an audio signal. In step, 672, the GT measure of a full-band frame is computed based on the SFM of the frame.

In decision step 674, the GT measure is compared to the GT threshold. If the GT measure is above the GT threshold, the audio frame is declared to be non-tonal (step 676) and the tonality flag for all sub-bands in the frame is not set.

If the GT measure is below the GT threshold, then the sub-bands in the frame are searched to tonal sub-bands (step 678). For each sub-band, the LT measure is computed, as discussed above in connection with FIG. 6B.

In step 680, the LT measure for each sub-band is compared to the LT threshold. If the LT measure is above the LT threshold, the audio sub-band frame is not tonal, and the tonality flag is not set for the sub-band. However, if the LT measure is below the LT threshold, the sub-band frame is tonal, and the tonality flag corresponding to the sub-band frame is set.

Figure 7A:
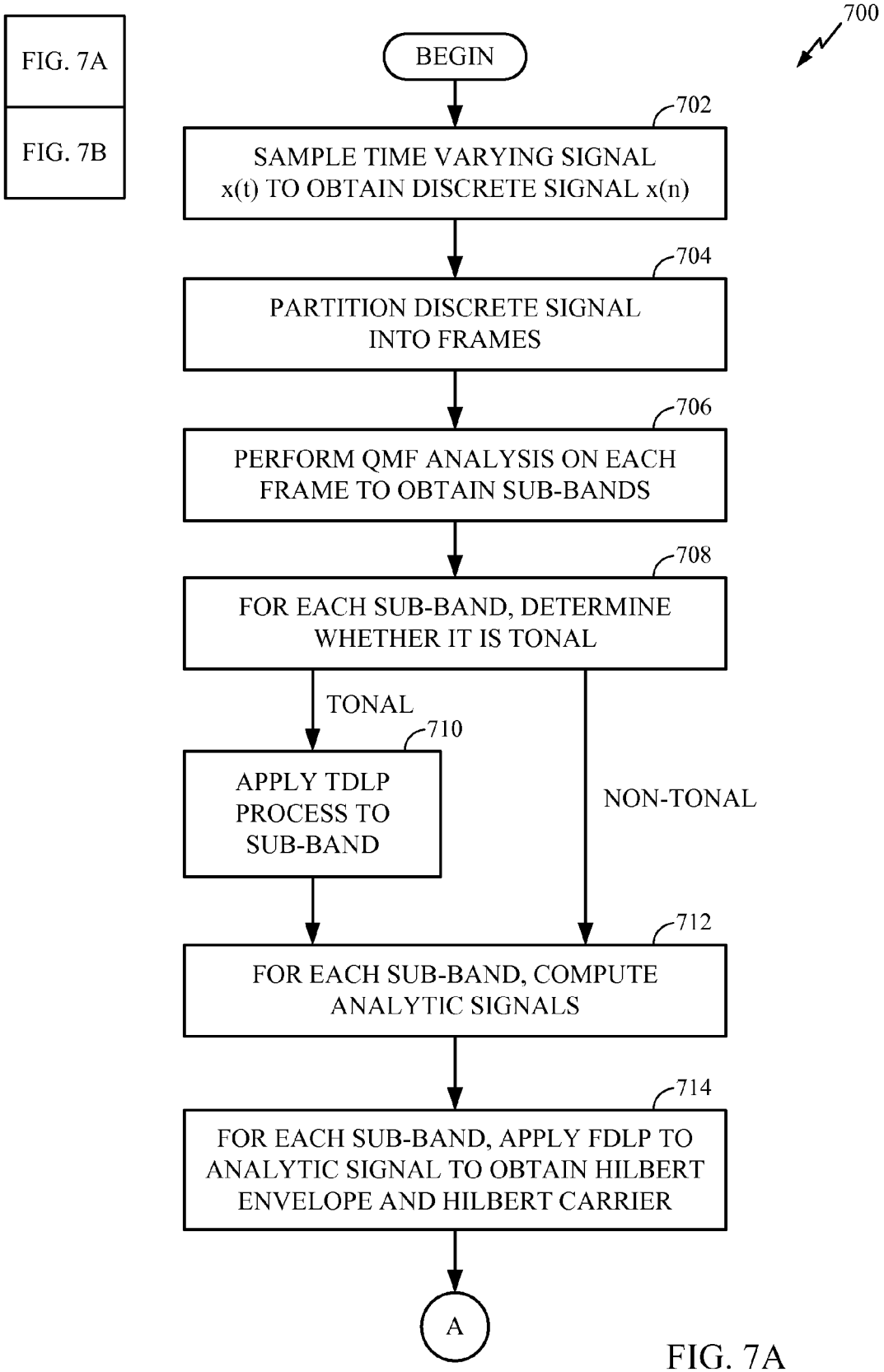
FIGS. 7A-B are a flowchart illustrating a method of encoding signals using an FDLP encoding scheme that employs SNS.
Figure 7B:
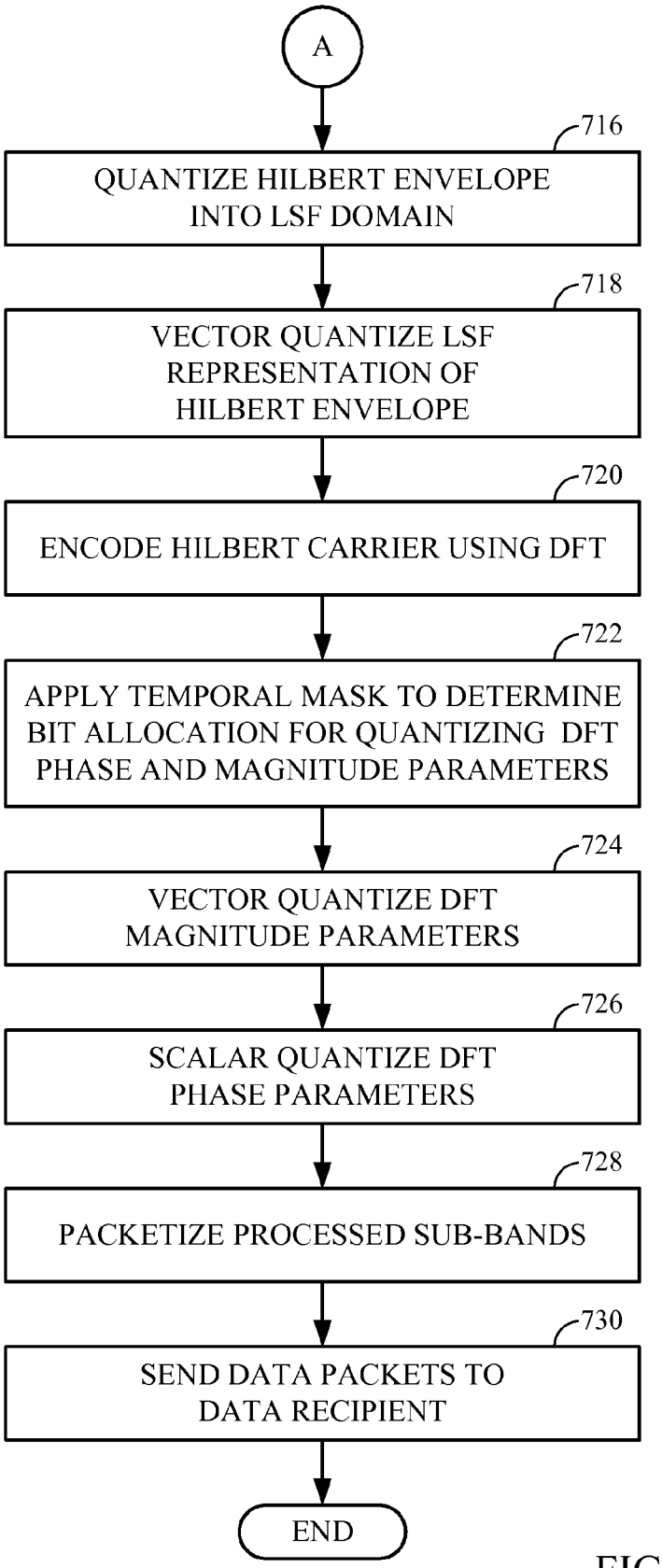

FIGS. 7A-B are a flowchart 700 illustrating a method of encoding signals using an FDLP encoding scheme that employs SNS. In step 702, a time-varying input signal x(t) is sampled into a discrete input signal x(n). The time-varying signal x(t) is sampled, for example, via the process of pulse-code modulation (PCM). The discrete version of the signal x(t) is represented by x(n).

Figure 12:
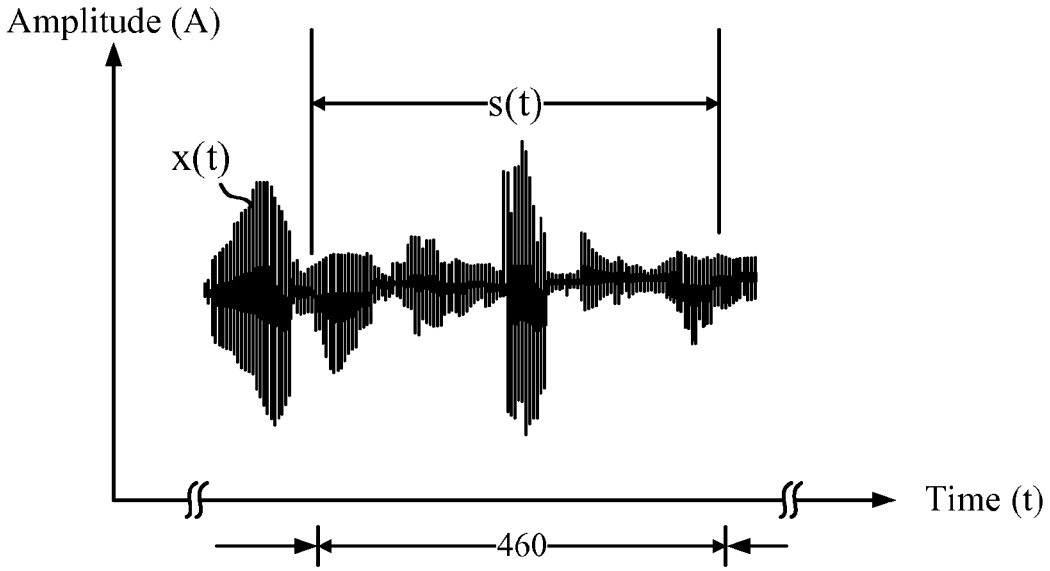
FIG. 12 is a graphical representation of a time-varying signal partitioned into a plurality of frames.

Next, in step 704, the discrete input signal x(n) is partitioned into frames. One of such frame of the time-varying signal x(t) is signified by the reference numeral 460 as shown in FIG. 12. Each frame preferably includes discrete samples that represent 1000 milliseconds of the input signal x(t). The time-varying signal within the selected frame 460 is labeled s(t) in FIG. 12. The continuous signal s(t) is highlighted and duplicated in FIG. 13. It should be noted that the signal segment s(t) shown in FIG. 13 has a much elongated time scale compared with the same signal segment s(t) as illustrated in FIG. 12. That is, the time scale of the x-axis in FIG. 13 is significantly stretched apart in comparison with the corresponding x-axis scale of FIG. 12.

Figure 13:
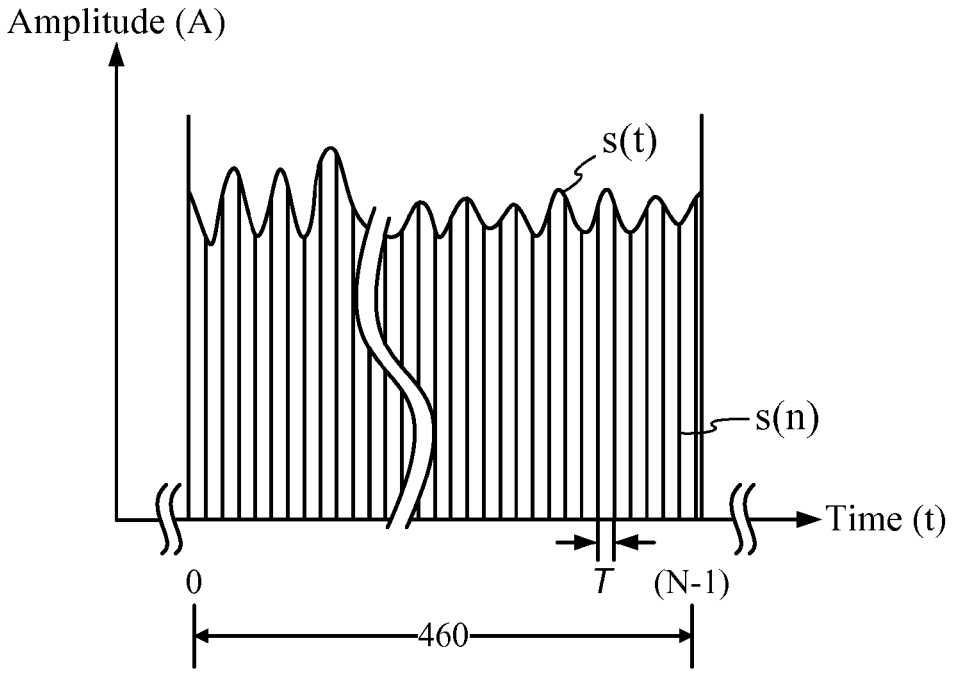
FIG. 13 is a graphical representation of a discrete signal representation of a time-varying signal over the duration of a frame.

The discrete version of the signal s(t) is represented by s(n), where n is an integer indexing the sample number. The time-continuous signal s(t) is related to the discrete signal s(n) by the following algebraic expression:

$$s(t)=s(n\tau), \tag{1}$$

where $\tau$ is the sampling period as shown in FIG. 13.

In step 706, each frame is decomposed into a plurality of frequency sub-bands. QMF analysis may be applied to each frame to produce the sub-band frames. Each sub-band frame represents a predetermined bandwidth slice of the input signal over the duration of a frame.

In step 708, a determination is made for each sub-band frame whether it is tonal. This can be performed by a tonality detector, such as the tonality detector 314 described above in connection with FIGS. 3 and 6A-C. If a sub-band frame is tonal, TDLP process is applied to the sub-band frame (step 710). If the sub-band frame in non-tonal, TDLP process is not applied to the sub-band frame.

In step 712, the sampled signal, or TDLP residual if the signal is tonal, within each sub-band frame undergoes a frequency transform to obtain a frequency-domain signal for the sub-band frame. The sub-band sampled signal is denoted as $s_k(n)$ for the $k^{th}$ sub-band. In the exemplary decoder 38 disclosed herein, k is an integer value between 1 and 32, and the method of discrete Fourier transform (DFT) is preferably employed for the frequency transformation. A DFT of $s_k(n)$ can be expressed as:

$$T_k(f)=\mathcal{F}\{s_k(n)\} \tag{2}$$

where $s_k(n)$ is as defined above, $\mathcal{F}$ denotes the DFT operation, f is a discrete frequency within the sub-band in which $0 \leqq f \leqq N$, $T_k$ is the linear array of the N transformed values of the N pulses of $s_k(n)$ and N is an integer.

At this juncture, it helps to make a digression to define and distinguish the various frequency-domain and time-domain terms. The discrete time-domain signal in the $k^{th}$ sub-band $s_k(n)$ can be obtained by an inverse discrete Fourier transform (IDFT) of its corresponding frequency counterpart $T_k(f)$. The time-domain signal in the $k^{th}$ sub-band $s_k(n)$ essentially composes of two parts, namely, the time-domain Hilbert envelope $h_k(n)$ and the Hilbert carrier $c_k(n)$. Stated in another way, modulating the Hilbert carrier $c_k(n)$ with the Hilbert envelope $h_k(n)$ will result in the time-domain signal in the $k^{th}$ sub-band $s_k(n)$. Algebraically, it can be expressed as follows:

$$s_k(n)=\vec{h}_k(n)\cdot\vec{c}_k(n) \tag{3}$$

Thus, from equation (3), if the time-domain Hilbert envelope $h_k(n)$ and the Hilbert carrier $c_k(n)$ are known, the time-domain signal in the $k^{th}$ sub-band $s_k(n)$ can be reconstructed. The reconstructed signal approximates that of a lossless reconstruction.

FDLP is applied to each sub-band frequency-domain signal to obtain a Hilbert envelope and Hilbert carrier corresponding to the respective sub-band frame (step 714). The Hilbert envelope portion is approximated by the FDLP scheme as an all-pole model. The Hilbert carrier portion, which represents the residual of the all-pole model, is approximately estimated.

As mentioned earlier, the time-domain term Hilbert envelope $h_k(n)$ in the $k^{th}$ sub-band can be derived from the corresponding frequency-domain parameter $T_k(f)$. In step 714, the process of frequency-domain linear prediction (FDLP) of the parameter $T_k(f)$ is employed to accomplish this. Data resulting from the FDLP process can be more streamlined, and consequently more suitable for transmission or storage.

In the following paragraphs, the FDLP process is briefly described followed with a more detailed explanation.

Briefly stated, in the FDLP process, the frequency-domain counterpart of the Hilbert envelope $h_k(n)$ is estimated, which counterpart is algebraically expressed as $\tilde{T}_k(f)$. However, the signal intended to be encoded is $s_k(n)$. The frequency-domain counterpart of the parameter $s_k(n)$ is $T_k(f)$. To obtain $T_k(f)$ from $s_k(n)$ an excitation signal, such as white noise is used. As will be described below, since the parameter $\tilde{T}_k(f)$ is an approximation, the difference between the approximated value $\tilde{T}_k(f)$ and the actual value $T_k(f)$ can also be estimated, which difference is expressed as $C_k(f)$. The parameter $C_k(f)$ is called the frequency-domain Hilbert carrier, and is also sometimes called the residual value. After performing an inverse FLDP process, the signal $s_k(n)$ is directly obtained.

Hereinbelow, further details of the FDLP process for estimating the Hilbert envelope and the Hilbert carrier parameter $C_k(f)$ are described.

An auto-regressive (AR) model of the Hilbert envelope for each sub-band may be derived using the method shown by flowchart 500 of FIG. 14. In step 502, an analytic signal $v_k(n)$ is obtained from $s_k(n)$. For the discrete-time signal $s_k(n)$, the analytic signal can be obtained using a FIR filter, or alternatively, a DFT method. With the DFT method specifically, the procedure for creating a complex-valued N-point discrete-time analytic signal $v_k(n)$ from a real-valued N-point discrete time signal $s_k(n)$, is given as follows. First, the N-point DFT, $T_k(f)$, is computed from $s_k(n)$. Next, an N-point, one-sided discrete-time analytic signal spectrum is formed by making the signal $T_k(f)$ causal (assuming N to be even), according to Equation (4) below:

$$X_k(f)=\begin{cases} T_k(0), & \text{for } f=0, \\ 2T_k(f), & \text{for } 1 \le f \le N/2-1, \\ T_k(N/2) & \text{for } f=N/2, \\ 0, & \text{for } N/2+1 \le k \le N \end{cases} \tag{4}$$

The N-point inverse DFT of $X_k(f)$ is then computed to obtain the analytic signal $v_k(n)$.

Next, in step 505, the Hilbert envelop is estimated from the analytic signal $v_k(n)$. The Hilbert envelope is essentially the squared magnitude of the analytic signal, i.e., $$h_k(n)=|v_k(n)|^2=v_k(n)v_k^*(n), \tag{5}$$

where $v_k^*(n)$ denotes the complex conjugate of $v_k(n)$.

In step 507, the spectral auto-correlation function of the Hilbert envelope is obtained as a discrete Fourier transform (DFT) of the Hilbert envelope of the discrete signal. The DFT of the Hilbert envelope can be written as:

$$E_k(f)=X_k(f)*X_k^*(-f)=\sum_{p=1}^{N}X_k(p)X_k^*(p-f)=r(f), \tag{6}$$

where $X_k(f)$ denotes the DFT of the analytic signal and r(f) denotes the spectral auto-correlation function. The Hilbert envelope of the discrete signal $s_k(n)$ and the auto-correlation in the spectral domain form Fourier Transform pairs. In a manner similar to the computation of the auto-correlation of the signal using the inverse Fourier transform of the power spectrum, the spectral auto-correlation function can thus be obtained as the Fourier transform of the Hilbert envelope. In step 509, these spectral auto-correlations are used by a selected linear prediction technique to perform AR modeling of the Hilbert envelope by solving, for example, a linear system of equations. As discussed in further detail below, the algorithm of Levinson-Durbin can be employed for the linear prediction. Once the AR modeling is performed, the resulting estimated FDLP Hilbert envelope is made causal to correspond to the original causal sequence $s_k(n)$. In step 511, the Hilbert carrier is computed from the model of the Hilbert envelope. Some of the techniques described hereinbelow may be used to derive the Hilbert carrier from the Hilbert envelop model.

In general, the spectral auto-correlation function produced by the method of FIG. 14 will be complex since the Hilbert envelope is not even-symmetric. In order to obtain a real auto-correlation function (in the spectral domain), the input signal is symmetrized in the following manner:

$$s_e(n)=(s(n)+s(-n))/2, \tag{7}$$

where $s_e[n]$ denotes the even-symmetric part of s. The Hilbert envelope of $s_e(n)$ will be also be even-symmetric and hence, this will result in a real valued auto-correlation function in the spectral domain. This step of generating a real valued spectral auto-correlation is done for simplicity in the computation, although, the linear prediction can be done equally well for complex valued signals.

In an alternative configuration of the encoder 38, a different process, relying instead on a DCT, can be used to arrive at the estimated Hilbert envelope for each sub-band. In this configuration, the transform of the discrete signal $s_k(n)$ from the time domain into the frequency domain can be expressed mathematically as follows:

$$T_k(f) = c(f)\sum_{n=0}^{N-1} s_k(n)\cos\frac{\pi(2n+1)f}{2N} \tag{8}$$

where $s_k(n)$ is as defined above, f is the discrete frequency within the sub-band in which $0 \leqq f \leqq N$, $T_k$ is the linear array of the N transformed values of the N pulses of $s_k(n)$, and the coefficients c are given by $c(0)=\sqrt{1/N}$, $c(f)=\sqrt{2/N}$ for $1 \leqq f \leqq N-1$, where N is an integer.

The N pulsed samples of the frequency-domain transform $T_k(f)$ are called DCT coefficients.

The discrete time-domain signal in the $k^{th}$ sub-band $s_k(n)$ can be obtained by an inverse discrete cosine transform (IDCT) of its corresponding frequency counterpart $T_k(f)$. Mathematically, it is expressed as follows:

$$s_k(n) = \sum_{f=0}^{N-1} c(f)T_k(f)\cos\frac{\pi(2n+1)f}{2N} \tag{9}$$

where $s_k(n)$ and $T_k(f)$ are as defined above. Again, f is the discrete frequency in which $0 \leqq f \leqq N$, and the coefficients c are given by $c(0)=\sqrt{1/N}$, $c(f)=\sqrt{2/N}$ for $1 \leqq f \leqq N-1$.

Using either of the DFT or DCT approaches discussed above, the Hilbert envelope may be modeled using the algorithm of Levinson-Durbin. Mathematically, the parameters to be estimated by the Levinson-Durbin algorithm can be expressed as follows:

$$H(z) = \frac{1}{1 + \sum_{i=0}^{K-1} a(i)z^{-k}} \tag{10}$$

in which H(z) is a transfer function in the z-domain, approximating the time-domain Hilbert envelope $h_k(n)$; z is a complex variable in the z-domain; a(i) is the $i^{th}$ coefficient of the all-pole model which approximates the frequency-domain counterpart $\tilde{T}_k(f)$ of the Hilbert envelope $h_k(n)$; $i=0, \ldots, K-1$. The time-domain Hilbert envelope $h_k(n)$ has been described above (e.g., see FIGS. 7 and 14).

Fundamentals of the Z-transform in the z-domain can be found in a publication, entitled "Discrete-Time Signal Processing," $2^{nd}$ Edition, by Alan V. Oppenheim, Ronald W. Schafer, John R. Buck, Prentice Hall, ISBN: 0137549202, and is not further elaborated in here.

In Equation (10), the value of K can be selected based on the length of the frame 460 (FIG. 12). In the exemplary decoder 38, K is chosen to be 20 with the time duration of the frame 460 set at 1000 mS.

In essence, in the FDLP process as exemplified by Equation (10), the DCT coefficients of the frequency-domain transform in the $k^{th}$ sub-band $T_k(f)$ are processed via the Levinson-Durbin algorithm resulting in a set of coefficients a(i), where $0<i<K-1$, of the frequency counterpart $\tilde{T}_k(f)$ of the time-domain Hilbert envelope $h_k(n)$.

The Levinson-Durbin algorithm is well known in the art and is not repeated in here. The fundamentals of the algorithm can be found in a publication, entitled "Digital Processing of Speech Signals," by Rabiner and Schafer, Prentice Hall, ISBN: 0132136031, September 1978.

Returning now to the method of FIG. 7, the resultant coefficients a(i) of the all-pole model Hilbert envelope are quantized into the line spectral frequency (LSF) domain (step 716). The LSF representation of the Hilbert envelop for each sub-band frame is quantized using the split VQ 312.

As mentioned above and repeated in here, since the parameter $\tilde{T}_k(f)$ is a lossy approximation of the original parameter $T_k(f)$, the difference of the two parameters is called the residual value, which is algebraically expressed as $C_k(f)$. Differently put, in the fitting process via the Levinson-Durbin algorithm as aforementioned to arrive at the all-pole model, some information about the original signal cannot be captured. If signal encoding of high quality is intended, that is, if a lossless encoding is desired, the residual value $C_k(f)$ needs to be estimated. The residual value $C_k(f)$ basically comprises the frequency components of the carrier frequency $c_k(n)$ of the signal $s_k(n)$.

There are several approaches in estimating the Hilbert carrier $c_k(n)$.

Estimation of the Hilbert carrier in the time-domain as residual value $c_k(n)$ is simply derived from a scalar division of the original time-domain sub-band signal $s_k(n)$ by its Hilbert envelope $h_k(n)$. Mathematically, it is expressed as follows:

$$c_k(n)=s_k(n)/h_k(n) \tag{11}$$

where all the parameters are as defined above.

It should be noted that Equation (11) is shown a straightforward way of estimating the residual value. Other approaches can also be used for estimation. For instance, the frequency-domain residual value $C_k(f)$ can very well be generated from the difference between the parameters $T_k(f)$ and $\tilde{T}_k(f)$. Thereafter, the time-domain residual value $c_k(n)$ can be obtained by a direct time-domain transform of the value $C_k(f)$.

Another straightforward approach is to assume the Hilbert carrier $c_k(n)$ is mostly composed of white noise. One way to obtain the white noise information is to band-pass filter the original signal x(t) (FIG. 12). In the filtering process, major frequency components of the white noise can be identified. The quality of reconstructed signal at the receiver depends on the accuracy with which the Hilbert carrier is represented at the receiver.

If the original signal x(t) (FIG. 12) is a voiced signal, that is, a vocalic speech segment originated from a human, it is found that the Hilbert carrier $c_k(n)$ can be quite predictable with only few frequency components. This is especially true if the sub-band is located at the low frequency end, that is, k is relatively low in value. The parameter $C_k(f)$, when expressed in the time domain, is in fact is the Hilbert carrier $c_k(n)$. With a voiced signal, the Hilbert carrier $c_k(n)$ is quite regular and can be expressed with only few sinusoidal frequency components. For a reasonably high quality encoding, only the strongest components can selected. For example, using the "peak picking" method, the sinusoidal frequency components around the frequency peaks can be chosen as the components of the Hilbert carrier $c_k(n)$.

As another alternative in estimating the residual signal, each sub-band k can be assigned, a priori, a fundamental frequency component. By analyzing the spectral components of the Hilbert carrier $c_k(n)$, the fundamental frequency component or components of each sub-band can be estimated and used along with their multiple harmonics.

For a more faithful signal reconstruction irrespective of whether the original signal source is voiced or unvoiced, a combination of the above mentioned methods can be used. For instance, via simple thresholding on the Hilbert carrier in the frequency domain $C_k(f)$, it can be detected and determined whether the original signal segment s(t) is voiced or unvoiced. Thus, if the signal segment s(t) is determined to be voiced, the "peak picking" spectral estimation method. On the other hand, if the signal segment s(t) is determined to be unvoiced, the white noise reconstruction method as aforementioned can be adopted.

There is yet another approach that can be used in the estimation of the Hilbert carrier $c_k(n)$. This approach involves the scalar quantization of the spectral components of the Hilbert carrier in the frequency domain $C_k(f)$. Here, after quantization, the magnitude and phase of the Hilbert carrier are represented by a lossy approximation such that the distortion introduced is minimized.

The estimated time-domain Hilbert carrier output from the FDLP for each sub-band frame is broken down into sub-frames. Each sub-frame represents a 200 millisecond portion of a frame, so there are five sub-frames per frame. Slightly longer, overlapping 210 ms long sub-frames (5 sub-frames created from 1000 ms frames) may be used in order to diminish transition effect or noise on frame boundaries. On the decoder side, a window which averages overlapping areas to get back the 1000 ms long Hilbert carrier may be applied.

The time-domain Hilbert carrier for each sub-band sub-frame is frequency transformed using DFT (step 720).

In step 722, a temporal mask is applied to determine the bit-allocations for quantization of the DFT phase and magnitude parameters. For each sub-band sub-frame, a comparison is made between a temporal mask value and the quantization noise determined for the baseline encoding process. The quantization of the DFT parameters may be adjusted as a result of this comparison, as discussed above in connection with FIG. 3. In step 724, the DFT magnitude parameters for each sub-band sub-frame are quantized using a split VQ, based, at least in part on the temporal mask comparison. In step 726, the DFT phase parameters are scalar quantized based, at least in part, on the temporal mask comparison.

In step 728, the encoded data and side information for each sub-band frame are concatenated and packetized in a format suitable for transmission or storage. As needed, various algorithms well known in the art, including data compression and encryption, can be implemented in the packetization process. Thereafter, the packetized data can be sent to the data handler 36, and then a recipient for subsequent decoding, as shown in step 730.

Figure 8:
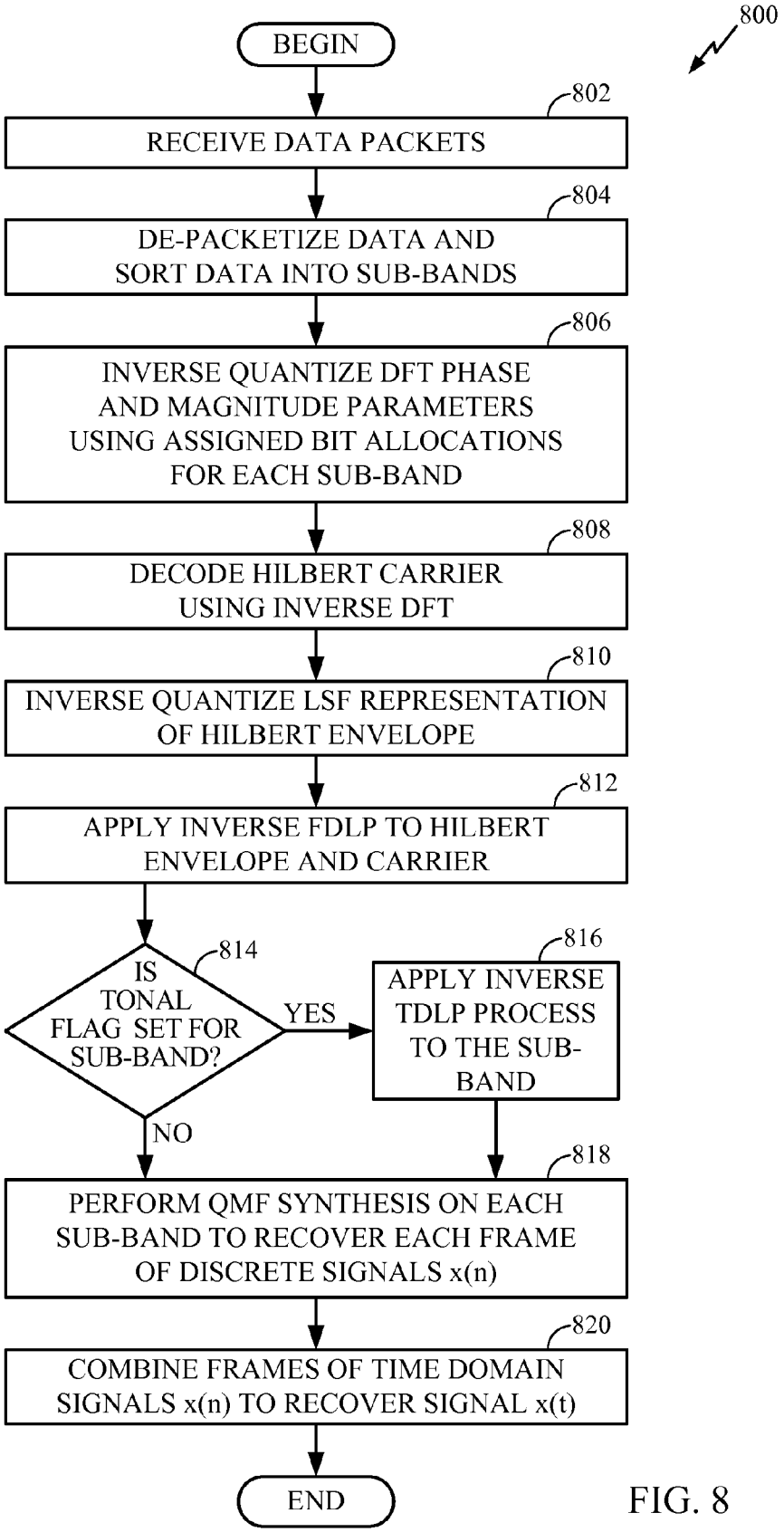
FIG. 8 is a flowchart illustrating a method of decoding signals using an FDLP decoding scheme that employs SNS.

FIG. 8 is a flowchart 800 illustrating a method of decoding signals using an FDLP decoding scheme. In step 802, one or more data packets are received, containing encoded data and side information for reconstructing an input signal. In step 804, the encoded data and information is de-packetized. The encoded data is sorted into sub-band frames.

In step 806, the DFT magnitude parameters representing the Hilbert carrier for each sub-band sub-frame are reconstructed from the VQ indices received by the decoder 42. The DFT phase parameters for each sub-band sub-frame are inverse quantized. The DFT magnitude parameters are inverse quantized using inverse split VQ and the DFT phase parameters are inverse quantized using inverse scalar quantization. The inverse quantizations of the DFT phase and magnitude parameter are performed using the bit-allocations assigned to each by the temporal masking that occurred in the encoding process.

In step 808, an inverse DFT is applied to each sub-band sub-frame to recover the time domain Hilbert carrier for the sub-band sub-frame. The sub-frames are then reassembled to form the Hilbert carriers for each sub-band frame.

In step 810, the received VQ indices for LSFs corresponding to Hilbert envelope for each sub-band frame are inverse quantized.

In step 812, each sub-band Hilbert carrier is modulated using the corresponding reconstructed Hilbert envelope. This may be performed by inverse FDLP component 512. The Hilbert envelope may be reconstructed by performing the steps of FIG. 14 in reverse for each sub-band.

In decision step 814, a check is made for each sub-band frame to determine whether it is tonal. This may be done by checking to determine whether the tonality flag sent from the encoder 38 is set. If the sub-band signal is tonal, inverse TDLP process is applied to the sub-band signal (i.e., the LPC coefficients and FDLP-decoded TDLP residual signal) to recover the sub-band frame (step 816). If the sub-band signal is not tonal, the TDLP processing is bypassed for the sub-band frame.

In step 818, all of the sub-bands are merged to obtain the full-band signal using QMF synthesis. This is performed for each frame.

In step 820, the recovered frames are combined to yield a reconstructed discrete input signal x'(n). Using suitable digital-to-analog conversion processes, the reconstructed discrete input signal x'(n) may be converted to a time-varying reconstructed input signal x'(t).

Figure 9:
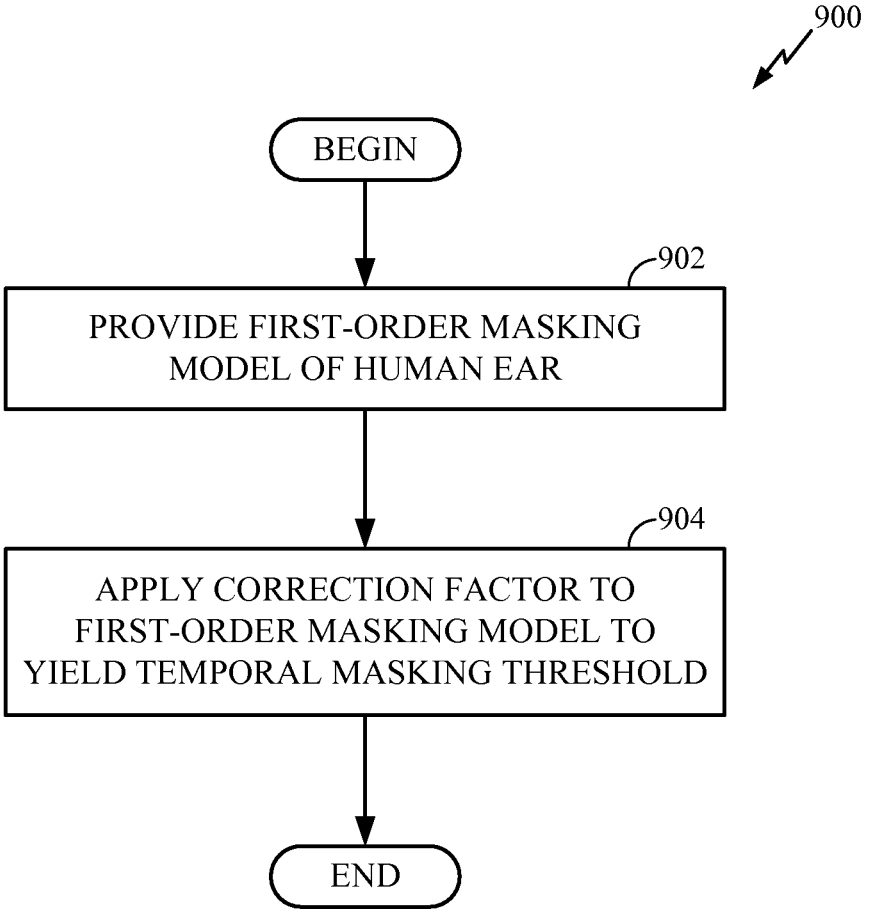
FIG. 9 is a flowchart illustrating a method of determining a temporal masking threshold.

FIG. 9 is a flowchart 900 illustrating a method of determining a temporal masking threshold. Temporal masking is a property of the human ear, where the sounds appearing for about 100-200 ms after a strong temporal signal get masked due to this strong temporal component. To obtain the exact thresholds of masking, informal listening experiments with additive white noise were performed.

In step 902, a first-order temporal masking model of the human provides the starting point for determining exact threshold values. The temporal masking of the human ear can be explained as a change in the time course of recovery from masking or as a change in the growth of masking at each signal delay. The amount of forward masking is determined by the interaction of a number of factors including masker level, the temporal separation of the masker and the signal, frequency of the masker and the signal and duration of the masker and the signal. A simple first-order mathematical model, which provides a sufficient approximation for the amount of temporal mask, is given in Equation (12).

$$M[n]=a(b-\log_{10}\Delta t)(s[n]-c) \tag{12}$$

where M is the temporal mask in dB Sound Pressure Level (SPL), s is the dB SPL level of a sample indicated by integer index n, Δt is the time delay in milliseconds, and a, b and c are the constants, and c represents an absolute threshold of hearing.

Figure 10:
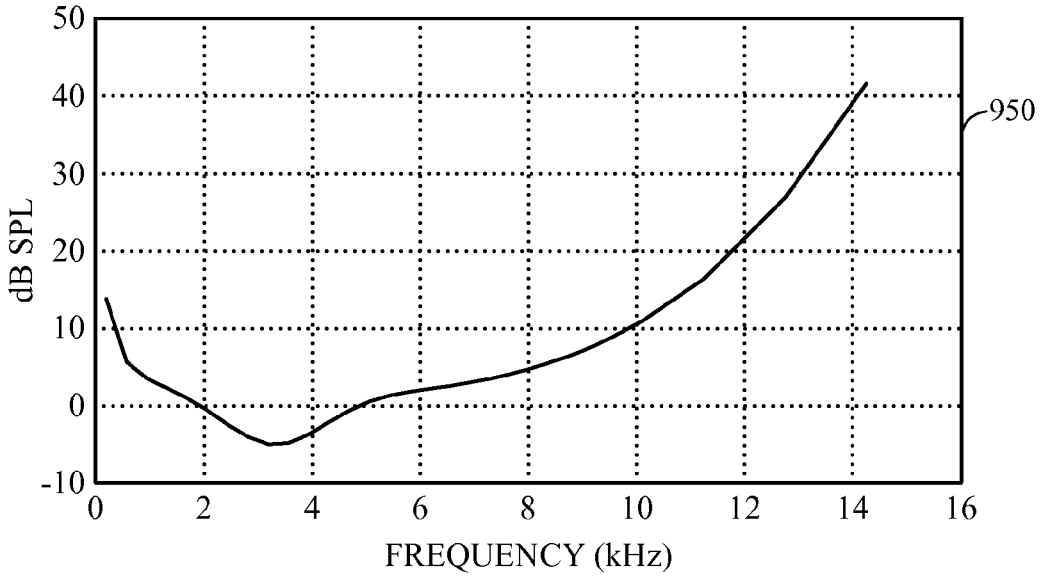
FIG. 10 is a graphical representation of the absolute hearing threshold of the human ear.

The optimal values of a and b are predefined and know to those of ordinary skill in the art. The parameter c is the Absolute Threshold of Hearing (ATH) given by the graph 950 shown in FIG. 10. The graph 950 shows the ATH as a function of frequency. The range of frequency shown in the graph 950 is that which is generally perceivable by the human ear.

The temporal mask is calculated using Equation (12) for every discrete sample in a sub-band sub-frame, resulting in a plurality of temporal mask values. For any given sample, multiple mask estimates corresponding to several previous samples are present. The maximum among these prior sample mask estimates is chosen as the temporal mask value, in units of dB SPL, for the current sample.

In step 904, a correction factor is applied to the first-order masking model (Eq. 12) to yield adjusted temporal masking thresholds. The correction factor can be any suitable adjustment to the first-order masking model, including but not limited to the exemplary set of Equations (13) shown hereinbelow.

Figure 11:
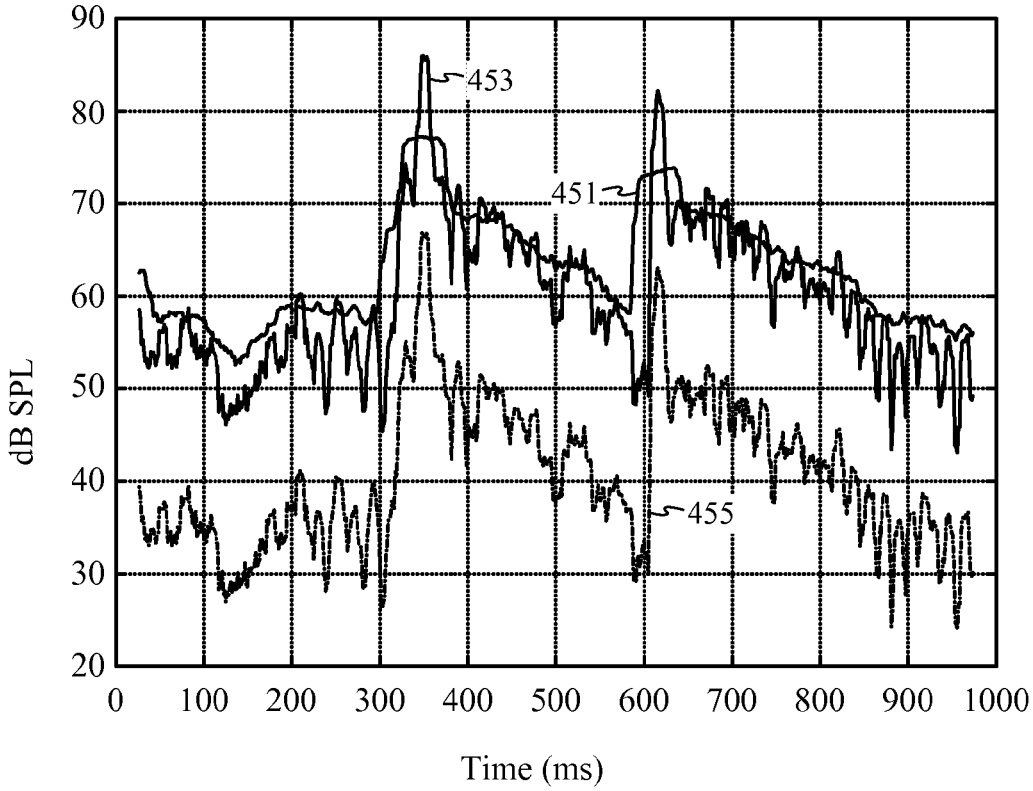
FIG. 11 is a graph showing an exemplary sub-band frame signal in dB SPL and its corresponding temporal masking thresholds and adjusted temporal masking thresholds.

One technique for correcting the first-order model is to determine the actual thresholds of imperceptible noise resulting from temporal masking. These thresholds may be determined by adding white noise with the power levels specified by the first-order mask model. The actual amount of white noise that can be added to an original input signal, so that audio included in the original input signal is perceptually transparent, may be determined using a set of informal listening tests with a variety people. The amount of power (in dB SPL), to be reduced from the first-order temporal masking threshold, is made dependent on the ATH in that frequency band. From informal listening tests with adding white noise, it was empirically found that the maximum power of the white noise that can be added to the original input signal, so that the audio is still perceptually transparent, is given by following exemplary set of equations:

$$\begin{aligned} T[n] &= L_m[n] - (35 - c), && \text{if } L_m[n] \geq (35 - c) \\ &= L_m[n] - (25 - c), && \text{if } (25 - c) \leq L_m[n] \leq (35 - c) \\ &= L_m[n] - (15 - c), && \text{if } (15 - c) \leq L_m[n] \leq (25 - c) \\ &= c, && \text{if } L_m[n] \leq (15 - c), \end{aligned} \tag{13}$$

where T[n] represents the adjusted temporal masking threshold at sample n, $L_m$ is a maximum value of the first-order temporal masking model (Eq. 12) computed at a plurality of previous samples, c represents an absolute threshold of hearing in dB, and n is an integer index representing the sample. On the average, the noise threshold is about 20 dB below the first-order temporal masking threshold estimated using Equation (12). As an example, FIG. 11 shows a frame (1000 ms duration) of a sub-band signal 451 in dB SPL, its temporal masking thresholds 453 obtained from Equation (12), and adjusted temporal masking thresholds 455 obtained from Equations (13).

The set of Equations (13) is only one example of a correction factor that can be applied to the linear model (Eq. 12). Other forms and types of correction factors are contemplated by the coding scheme disclosed herein. For example, the threshold constants, i.e., 35, 25, 15, of Equations 13 can be other values, and/or the number of equations (partitions) in the set and their corresponding applicable ranges can vary from those shown in Equations 13.

The adjusted temporal masking thresholds also show the maximum permissible quantization noise in the time domain for a particular sub-band. The objective is to reduce the number of bits required to quantize the DFT parameters of the sub-band Hilbert carriers. Note that the sub-band signal is a product of its Hilbert envelope and its Hilbert carrier. As previously described, the Hilbert envelope is quantized using scalar quantization. In order to account for the envelope information while applying temporal masking, the logarithm of the inverse quantized Hilbert envelope of a given sub-band is calculated in the dB SPL scale. This value is then subtracted from the adjusted temporal masking thresholds obtained from Equations (13).

The various methods, systems, apparatuses, components, functions, state machines, blocks, steps, devices and circuitry described herein may be implemented in hardware, software, firmware or any suitable combination of the foregoing. For example, the methods, systems, apparatuses, components, functions, state machines, blocks, steps, devices and circuitry described herein may be implemented, at least in part, with one or more general purpose processors, digital signal processors (DSPs), application specific integrated circuits (ASICs), field programmable gate arrays (FPGAs), intellectual property (IP) cores or other programmable logic devices, discrete gates or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The functions, state machines, components, blocks, steps, and methods described herein, if implemented in software, may be stored or transmitted as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer processor. Also, any transfer medium or connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above are also included within the scope of computer-readable media.

The above description of the disclosed embodiments is provided to enable any person skilled in the art to make or use that which is defined by the appended claims. The following claims are not intended to be limited to the disclosed embodiments. Other embodiments and modifications will readily occur to those of ordinary skill in the art in view of these teachings. Therefore, the following claims are intended to cover all such embodiments and modifications when viewed in conjunction with the above specification and accompanying drawings.

What is claimed is:

1. A method of spectral noise shaping in an audio coding apparatus, comprising:

determining whether an audio signal is tonal;

time domain linear prediction (TDLP) processing the tonal audio signal with the audio coding apparatus to produce a residual signal and linear predictive coding (LPC) coefficients; and applying a frequency domain linear prediction (FDLP) process to the residual signal with the audio coding apparatus.

2. The method of claim 1, further comprising:

encoding FDLP parameters from the FDLP process and the LPC coefficients; and transmitting the encoded FDLP parameters LPC coefficients to a decoder.

3. The method of claim 2, further comprising:

at the decoder:

decoding the encoded FDLP parameters and LPC coefficients to yield decoded FDLP parameters and decoded LPC coefficients;

applying an inverse FDLP process to the decoded FDLP parameters to yield a reconstructed residual signal; and applying inverse TDLP process to the reconstructed residual signal and the decoded LPC coefficients to yield a reconstructed audio signal.

4. The method of claim 1, further comprising:

generating a tonality flag indicating that the audio signal is tonal; and transmitting the tonality flag to a decoder.

5. The method of claim 1, wherein determining includes:

determining a global tonality measure;

determining a local tonality measure; and determining whether the audio signal is tonal based on the global and local tonality measures.

6. The method of claim 5, wherein the global tonality measure is based on a spectral flatness measure (SFM) computed over a predetermined frame of a full-band audio signal corresponding to the audio signal.

7. The method of claim 6, further comprising:

comparing the SFM to a predetermined threshold; and declaring the audio signal to be non-tonal if the SFM is above the predetermined threshold.

8. The method of claim 7, further comprising:

computing the local tonality measure of a frequency sub-band corresponding to the audio signal, if the SFM is below the predetermined threshold.

9. The method of claim 5, wherein determining the local tonality measure includes:

computing a discrete cosine transform (DCT) of the audio signal;

computing a plurality of auto-correlation values from the DCT;

determining a maximum auto-correlation value; and computing the ratio of the maximum auto-correlation value to the energy of the DCT, wherein the local tonality measure is based on the ratio.

10. The method of claim 5, further comprising:

providing a predetermined global tonality threshold and a predetermined local tonality threshold, each for comparison with the global tonality measure and local tonality measure, respectively.

11. The method of claim 10, wherein the predetermined global tonality threshold and the predetermined local tonality threshold are each determined empirically.

12. An apparatus, comprising:

means for determining whether an audio signal is tonal to provide a tonal audio signal;

means for time domain linear prediction (TDLP) processing the tonal audio signal to produce a residual signal and linear predictive coding (LPC) coefficients; and means for applying a frequency domain linear prediction (FDLP) process to the residual signal.

13. The apparatus of claim 12, further comprising:

means for encoding FDLP parameters from the FDLP process and the LPC coefficients; and means for transmitting the encoded FDLP parameters LPC coefficients to a decoder.

14. The apparatus of claim 13, further comprising:

at the decoder:

means for decoding the encoded FDLP parameters and LPC coefficients to yield decoded FDLP parameters and decoded LPC coefficients;

means for applying an inverse FDLP process to the decoded FDLP parameters to yield a reconstructed residual signal; and means for applying inverse TDLP process to the reconstructed residual signal and the decoded LPC coefficients to yield a reconstructed audio signal.

15. The apparatus of claim 12, further comprising:

means for generating a tonality flag indicating that the audio signal is tonal; and means for transmitting the tonality flag to a decoder.

16. The apparatus of claim 12, wherein the determining means includes:

means for determining a global tonality measure;

means for determining a local tonality measure; and means for determining whether the audio signal is tonal based on the global and local tonality measures.

17. The apparatus of claim 16, wherein the global tonality measure is based on a spectral flatness measure (SFM) computed over a predetermined frame of a full-band audio signal corresponding to the audio signal.

18. The apparatus of claim 17, further comprising:

means for comparing the SFM to a predetermined threshold; and means for declaring the audio signal to be non-tonal if the SFM is above the predetermined threshold.

19. The apparatus of claim 18, further comprising:

means for computing the local tonality measure of a frequency sub-band corresponding to the audio signal, if the SFM is below the predetermined threshold.

20. The apparatus of claim 16, wherein means for determining the local tonality measure includes:

means for computing a discrete cosine transform (DCT) of the audio signal;

means for computing a plurality of auto-correlation values from the DCT;

means for determining a maximum auto-correlation value; and means for computing the ratio of the maximum auto-correlation value to the energy of the DCT, wherein the local tonality measure is based on the ratio.

21. The apparatus of claim 16, further comprising:

means for providing a predetermined global tonality threshold and a predetermined local tonality threshold, each for comparison with the global tonality measure and local tonality measure, respectively.

22. The apparatus of claim 21, wherein the predetermined global tonality threshold and the predetermined local tonality threshold are each determined empirically.

23. The apparatus of claim 12, included in a wireless communication device.

24. An apparatus, comprising:

a tonality detector configured to output a tonal audio signal based on a determination of whether an audio signal is tonal;

a time domain linear prediction (TDLP) process configured to produce a residual signal and linear predictive coding (LPC) coefficients in response to the tonal audio signal; and a frequency domain linear prediction (FDLP) component configured to process the residual signal;

wherein the TDLP process or the FDLP component are implemented, at least in part, in hardware.

25. The apparatus of claim 24, further comprising:

an encoder configured to encode FDLP parameters from the FDLP component and the LPC coefficients; and a transmitter configured to transmit the encoded FDLP parameters LPC coefficients to a decoder.

26. The apparatus of claim 25, further comprising:

the decoder configured to decode the encoded FDLP parameters and LPC coefficients to yield decoded FDLP parameters and decoded LPC coefficients;

an inverse FDLP component configured to process the decoded FDLP parameters to yield a reconstructed residual signal; and an inverse TDLP process configured to produce a reconstructed audio signal in response to the reconstructed residual signal and the decoded LPC coefficients.

27. The apparatus of claim 24, wherein the tonality detector is further configured to generate a tonality flag indicating that the audio signal is tonal; and the apparatus further comprises a transmitter configured to transmit the tonality flag to a decoder.

28. The apparatus of claim 24, wherein the tonality detector includes:

a global tonality calculator configured to determine global tonality measure;

a local tonality calculator configured to determine a local tonality measure; and a comparator configured to determine whether the audio signal is tonal based on the global and local tonality measures.

29. The apparatus of claim 28, wherein the global tonality measure is based on a spectral flatness measure (SFM) computed over a predetermined frame of a full-band audio signal corresponding to the audio signal.

30. The apparatus of claim 29, wherein the comparator is configured to compare the SFM to a predetermined threshold and to declare the audio signal to be non-tonal if the SFM is above the predetermined threshold.

31. The apparatus of claim 30, wherein the local tonality calculator is further configured to compute the local tonality measure of a frequency sub-band corresponding to the audio signal, if the SFM is below the predetermined threshold.

32. The apparatus of claim 28, wherein the local tonality calculator includes:

a DCT calculator configured to computer a discrete cosine transform (DCT) of the audio signal;

an auto-correlator configured to compute a plurality of auto-correlation values from the DCT;

a maximum value detector configured to determine a maximum auto-correlation value; and a ratio calculator configured to compute the ratio of the maximum auto-correlation value to the energy of the DCT, wherein the local tonality measure is based on the ratio.

33. The apparatus of claim 28, further comprising:

a threshold calculator configured to provide a predetermined global tonality threshold and a predetermined local tonality threshold, each for comparison with the global tonality measure and local tonality measure, respectively.

34. The apparatus of claim 33, wherein the predetermined global tonality threshold and the predetermined local tonality threshold are each determined empirically.

35. The apparatus of claim 24, included in a wireless communication device.

36. A non-transitory computer-readable medium embodying a set of instructions executable by one or more processors, comprising:

code for determining whether an audio signal is tonal to provide a tonal audio signal;

code for time domain linear prediction (TDLP) processing the tonal audio signal to produce a residual signal and linear predictive coding (LPC) coefficients; and code for applying a frequency domain linear prediction (FDLP) process to the residual signal.

37. The computer-readable medium of claim 36, further comprising:

code for encoding FDLP parameters from the FDLP process and the LPC coefficients; and code for transmitting the encoded FDLP parameters LPC coefficients to a decoder.

38. The computer-readable medium of claim 37, further comprising:

code for decoding the encoded FDLP parameters and LPC coefficients to yield decoded FDLP parameters and decoded LPC coefficients;

code for applying an inverse FDLP process to the decoded FDLP parameters to yield a reconstructed residual signal; and code for applying inverse TDLP process to the reconstructed residual signal and the decoded LPC coefficients to yield a reconstructed audio signal.

39. The computer-readable medium of claim 36, further comprising:

code for generating a tonality flag indicating that the audio signal is tonal; and code for transmitting the tonality flag to a decoder.

40. The computer-readable medium of claim 36, wherein the determining code includes:

code for determining a global tonality measure;

code for determining a local tonality measure; and code for determining whether the audio signal is tonal based on the global and local tonality measures.

41. The computer-readable medium of claim 40, wherein the global tonality measure is based on a spectral flatness measure (SFM) computed over a predetermined frame of a full-band audio signal corresponding to the audio signal.

42. The computer-readable medium of claim 41, further comprising:

code for comparing the SFM to a predetermined threshold; and code for declaring the audio signal to be non-tonal if the SFM is above the predetermined threshold.

43. The computer-readable medium of claim 42, further comprising:

code for computing the local tonality measure of a frequency sub-band corresponding to the audio signal, if the SFM is below the predetermined threshold.

44. The computer-readable medium of claim 40, wherein code for determining the local tonality measure includes:

code for computing a discrete cosine transform (DCT) of the audio signal;

code for computing a plurality of auto-correlation values from the DCT;

code for determining a maximum auto-correlation value; and code for computing the ratio of the maximum auto-correlation value to the energy of the DCT, wherein the local tonality measure is based on the ratio.

45. The computer-readable medium of claim 40, further comprising:

code for providing a predetermined global tonality threshold and a predetermined local tonality threshold, each for comparison with the global tonality measure and local tonality measure, respectively.

46. The computer-readable medium of claim 45, wherein the predetermined global tonality threshold and the predetermined local tonality threshold are each determined empirically.

* * * * *